US007933534B2

(12) United States Patent
Hoshi et al.

(10) Patent No.: US 7,933,534 B2
(45) Date of Patent: Apr. 26, 2011

(54) DEVELOPING DEVICE FRAME UNIT, DEVELOPING DEVICE, PROCESS CARTRIDGE, AND MANUFACTURING METHOD OF THE DEVELOPING DEVICE FRAME UNIT

(75) Inventors: Nobuharu Hoshi, Numazu (JP); Akira Suzuki, Naka-gun (JP); Makoto Hayashida, Susono (JP); Kazuhiko Kanno, Odawara (JP); Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 12/359,601

(22) Filed: Jan. 26, 2009

(65) Prior Publication Data

US 2009/0245851 A1 Oct. 1, 2009

(30) Foreign Application Priority Data

Mar. 31, 2008 (JP) ..... 2008-093929
Jan. 6, 2009 (JP) ..... 2009-001164

(51) Int. Cl.
*G03G 15/08* (2006.01)

(52) U.S. Cl. ..... 399/103

(58) Field of Classification Search ..... 399/103, 399/105, 274, 284
See application file for complete search history.

(56) References Cited

U.S. PATENT DOCUMENTS 5,057,868 A 10/1991 Sekino et al.
5,485,249 A * 1/1996 Higeta et al. ..... 399/105
5,729,796 A 3/1998 Miura et al. ..... 399/114
5,740,499 A 4/1998 Higeta et al. ..... 399/105
5,768,658 A 6/1998 Watanabe et al. ..... 399/111
5,809,374 A 9/1998 Tsuda et al. ..... 399/111
5,815,644 A 9/1998 Nishiuwatoko et al. ..... 399/113
5,870,655 A 2/1999 Nishiuwatoko et al. ..... 399/111
5,893,006 A 4/1999 Kanno et al. ..... 399/13

(Continued)

FOREIGN PATENT DOCUMENTS

EP 0 442 472 A2 8/1991

(Continued)

OTHER PUBLICATIONS

PCT International Search Report and Written Opinion of International Search Authority in PCT/JP2009/051680 issued May 8, 2009.

*Primary Examiner* — Sandra L Brase
(74) *Attorney, Agent, or Firm* — Fitzpatrick, Cella, Harper & Scinto

(57) ABSTRACT

A developing device frame unit supporting a regulating member regulating the layer thickness of developer on a developer carrier. The unit includes a frame having a seal forming portion, first and second, first and second end seals contactable to the carrier surface to prevent carrier-axial-direction leaking of the developer, and a blade sealer sealing between the regulating member and the frame to prevent developer leaking when the regulating member is mounted. The blade sealer is an elastomer resin material which is injection-molded with a metal mold and in the seal forming portion where the end seals are provided. The blade sealer connects the end seals with each other, and a protrusion provided by a squeezed-out portion of the resin material is provided by injecting, into a space defined by the metal mold, the seal forming portion, and the end seal seals, a resin material volume larger than a volume of the space.

20 Claims, 22 Drawing Sheets

U.S. PATENT DOCUMENTS 5,926,666 A 7/1999 Miura et al. ..... 399/25
5,937,240 A 8/1999 Kanno et al. ..... 399/111
5,940,657 A 8/1999 Yokomori et al. ..... 399/119
5,950,049 A 9/1999 Yokomori et al. ..... 399/119
5,966,567 A 10/1999 Matsuzaki et al. ..... 399/111
6,070,029 A 5/2000 Nishiuwatoko et al. ..... 399/111
6,072,969 A 6/2000 Yokomori et al. ..... 399/119
6,078,763 A 6/2000 Hoshi ..... 399/111
6,144,815 A 11/2000 Chadani et al. ..... 399/27
6,154,623 A 11/2000 Suzuki et al. ..... 399/111
6,173,140 B1 1/2001 Suzuki et al. ..... 399/113
6,173,145 B1 1/2001 Chadani et al. ..... 399/265
6,205,305 B1 3/2001 Suzuki et al. ..... 399/106
6,246,853 B1 6/2001 Suzuki et al. ..... 399/262
6,282,389 B1 8/2001 Matsuzaki et al. ..... 399/111
6,321,050 B1 * 11/2001 Sato et al. ..... 399/103
6,336,015 B1 * 1/2002 Numagami ..... 399/105 X
6,345,164 B1 2/2002 Yokomori et al. ..... 399/119
6,381,430 B1 4/2002 Yokomori et al. ..... 399/119
6,385,416 B1 5/2002 Horikawa et al. ..... 399/111
6,415,121 B1 7/2002 Suzuki et al. ..... 399/111
6,442,359 B1 8/2002 Numagami et al. ..... 399/111
6,463,233 B2 10/2002 Kojima et al. ..... 399/111
6,487,383 B2 * 11/2002 Buchanan et al. ..... 399/103
6,496,667 B2 12/2002 Shiratori et al. ..... 399/103
6,516,168 B2 2/2003 Shiratori et al. ..... 399/103
6,549,736 B2 4/2003 Miyabe et al. ..... 399/111
6,560,422 B2 5/2003 Kanno et al. ..... 399/106
6,577,831 B1 6/2003 Kojima et al. ..... 399/111
6,654,578 B2 11/2003 Suzuki et al. ..... 399/111
6,681,088 B2 1/2004 Kanno et al. ..... 399/111
6,735,403 B2 5/2004 Kanno et al. ..... 399/103
6,823,153 B2 11/2004 Ueno et al. ..... 399/103
6,834,173 B2 12/2004 Yamaguchi et al. ..... 399/119
6,865,357 B2 3/2005 Fujita et al. ..... 399/111
6,868,243 B2 3/2005 Watanabe et al. ..... 399/113
6,873,815 B2 3/2005 Matsuda et al. ..... 399/260
6,934,485 B2 8/2005 Miyabe et al. ..... 399/90
6,937,834 B2 8/2005 Kanno et al. ..... 399/114
6,947,687 B2 9/2005 Yamaguchi et al. ..... 399/111
6,961,528 B2 11/2005 Yamaguchi et al. ..... 399/119
6,980,752 B2 * 12/2005 Kamimura ..... 399/103
6,980,759 B2 12/2005 Kanno et al. ..... 399/111
6,990,302 B2 1/2006 Toba et al. ..... 399/114
7,027,756 B2 4/2006 Hoshi et al. ..... 399/111
7,058,337 B2 6/2006 Hashimoto et al. ..... 399/111
7,072,594 B2 7/2006 Hoshi et al. ..... 399/27
7,099,607 B2 8/2006 Suzuki et al. ..... 399/111
7,127,194 B2 10/2006 Hoshi et al. ..... 399/111
7,184,686 B2 2/2007 Kanno et al. ..... 399/111
7,346,293 B2 3/2008 Suzuki et al. ..... 399/111
7,349,649 B2 3/2008 Hoshi et al. ..... 399/111
7,366,440 B2 4/2008 Horikawa ..... 399/111
7,386,241 B2 6/2008 Mori et al. ..... 399/12
7,463,844 B2 12/2008 Hashimoto et al. ..... 399/111
7,643,771 B2 * 1/2010 Fukuta ..... 399/103
2007/0092291 A1 4/2007 Suzuki et al. ..... 399/111
2008/0138105 A1 6/2008 Kanno et al. ..... 399/111
2008/0138106 A1 6/2008 Kanno et al. ..... 399/111
2008/0138110 A1 6/2008 Yoshino et al. ..... 399/114
2008/0145095 A1 6/2008 Hoshi et al. ..... 399/111

FOREIGN PATENT DOCUMENTS

JP 11-272071 10/1999
JP 2004-126003 4/2004

* cited by examiner (a)

(b)

(a)

(b)

PRIOR ART

PRIOR ART

PRIOR ART

PRIOR ART

DEVELOPING DEVICE FRAME UNIT, DEVELOPING DEVICE, PROCESS CARTRIDGE, AND MANUFACTURING METHOD OF THE DEVELOPING DEVICE FRAME UNIT

FIELD OF THE INVENTION AND RELATED ART

The present invention relates to an electrophotographic image forming apparatus for forming an image on a recording medium in general. Particularly, the present invention relates to a developing device for developing an electrostatic latent image formed on an image bearing member in the electrophotographic image forming apparatus and a process cartridge detachably mountable to the electrophotographic image forming apparatus. Further, the present invention relates to a developing device frame unit having a regulating member for regulating the layer thickness of developer on a developer carrying member for developing the electrostatic latent image on the image bearing member and a manufacturing method of the developing device frame unit.

The process cartridge is prepared by integrally supporting at least a developing means and an electrophotographic photosensitive drum and is detachably mountable to a main assembly of the electrophotographic image forming apparatus.

The electrophotographic image forming apparatus is used for forming the image on a recording medium by using an electrophotographic image forming method and includes, e.g., an electrophotographic copying machine, an electrophotographic printer (such as a laser beam printer or an LED printer), and a facsimile machine.

In a conventional electrophotographic image forming apparatus using an electrophotographic image forming process, an electrophotographic photosensitive member and process means acting thereon are integrally formed into a unit to provide a process cartridge. The process cartridge is configured to be detachably mountable to an image forming apparatus main assembly.

In such a process cartridge, between frames and between parts constituting the process cartridge, a plurality of seal members is disposed for sealing in order to prevent developer (toner) accommodated in the process cartridge from leaking to the outside.

As the seal member, an elastic member such as urethane foam, soft rubber or elastomer resin material is used. The seal member is generally provided at a connecting portion between the frames and between the parts described above so as to seal up the connecting portion by being compression-deformed in a predetermined compression amount.

Further, the developing device (developing unit) in the process cartridge includes a developer carrying member (developing roller) for carrying and conveying the developer in a developing container and a developer regulating member (developing blade) for regulating a developing layer thickness on the developing roller. Also such a developing unit is configured to be sealed with a plurality of seal members r or the like in order to prevent the developer (toner) contained in the developing container from leaking to the outside through the above-described constituent members.

The seal member is disposed to cover a periphery of a toner supplying opening of the developing container and at a gap between the process cartridge and the developing blade, an elastic under blade seal, such as urethane foam, is disposed. Further, at both longitudinal end portions, at a gap between the developing container and a back surface of the developing blade and at a gap between the developing container and a peripheral surface of the developing roller, a flexible end seal member or the like formed of felt or the like is disposed at a surface at which the end seal member rubs against the developing roller.

Further, at both longitudinal end portions, between the under blade seal and the end seal member, a projection is provided at both end portions of the under blade seal so as to be compressed by press-contact of the projection with side surfaces of the end seal member. By such a constitution, close contact at a joining portion between the seal members is enhanced to prevent the toner from leaking from the joining portion (Japanese Laid-Open Patent Application (JP-A) Hei 11-272071).

In the above-described seal constitution, application accuracy of the seal members was important for press-contacting the projections with reliability, so that an application operation was required to be performed manually with high accuracy.

In order to improve such an operation, a predetermined space is provided between the seal members and into the space, and an adhesive or a hot-melt adhesive or the like is injected as a bulking material to seal the space between the seal members (JP-A 2004-126003). Also in such a seal constitution, it is necessary to adjust the amount of the adhesive to be injected into the space depending on the application accuracy of the seal members.

However, the above-described conventional seal constitutions have the following problem.

FIG. 17 shows an embodiment of a process cartridge. In this embodiment, a process cartridge 2 is separated into a photosensitive drum unit 2*a* and a developing unit 2*b*.

In the photosensitive drum unit 2*a*, a photosensitive drum 21 is rotatably mounted to a cleaning frame 24. At a peripheral surface of the photosensitive drum 21, a charging roller 23 as a primary charging means for electrically charging the surface of the photosensitive drum 21 uniformly and a cleaning blade 28 for removing the developer (toner) remaining on the photosensitive drum 21 are disposed.

The developing unit 2*b* is constituted by a toner container 70A in which the developer (toner) is accommodated and a developing container 70B rotatably supporting a developing roller 22 as a developer carrying member.

The developing roller 22 contacts the photosensitive drum 21 and rotates in a direction of an arrow Y. At a peripheral surface of the developing roller 22, a toner supplying roller 72 for rotating in a direction of an arrow Z in contact with the developing roller 22 and a developing blade unit 73 are disposed.

FIG. 18 is a partial schematic sectional view of the developing unit 2*b* and FIG. 19 is a schematic front view of the developing unit 2*b*. FIG. 20 is a schematic front view showing a state in which the developing blade unit 73 is removed from the developing container 70B.

Referring to FIGS. 18 to 20, the developing roller 22 and the developing blade unit 73 are integrally mounted to a developing device frame 71 through end seal members 95*a* and 95*b* provided to the developing device frame 71 and a seal member 93. As a result, the leaking of the toner contained in the developing container 70B to the outside is prevented.

The developing blade unit 73 includes a developing blade 73*b* as a regulating member for regulating the amount of toner on the developing roller 22 and a supporting plate 73*a* for supporting the developing blade 73*b*.

In the conventional seal constitutions, between an under blade seal 93 and the end seal member 95*a*, a gap occurs. For this reason, the gap is sealed with a bulking material 92 by injecting the bulking material 92 from a hole 73*c* provided to the developing blade unit 73. However, in this method, an additional injection step of injecting the bulking material 92 was required to result in an increase in cost due to an increase in assembly time.

SUMMARY OF THE INVENTION

A principal object of the present invention is to provide a developing device frame unit, a developing device, a process cartridge, and a manufacturing method of the developing device frame unit, in which even when a variation in the application position of one end seal member and the other end seal member is caused to occur, the sealing property at boundary portions between respective seal members is stabilized by bringing a blade seal member, disposed between one end seal member and the other end seal member, and one end seal member and the other end seal member into contact with each other.

Another object of the present invention is to provide a developing device frame unit, a developing device, a process cartridge, and a manufacturing method of the developing device frame unit, in which the blade seal member is formed with no gap with one end seal member and with no gap with the other end seal member to realize a simple seal constitution and a reduction in the number of assembly steps, thus resulting in a reduction of manufacturing costs.

As further object of the present invention, there is provided a developing device frame unit, a developing device, a process cartridge, and a manufacturing method of the developing device frame unit, in which the assembling property of the blade is improved by being directly formed on a developing device frame.

According to an aspect of the present invention, there is provided a developing device frame unit for supporting a regulating member for regulating the layer thickness of a developer on a developer carrying member. The developing device frame unit comprises a developing device frame having a seal forming portion, a one end sealing member which is provided at one longitudinal end of the developing device frame and which is contactable to a surface of the developer carrying member to prevent the developer from leaking in an axial direction of the developer carrying member when the developer carrying member is mounted to the developing device frame unit, an other end sealing member which is provided at the other longitudinal end of the developing device frame and which is contactable to the surface of the developer carrying member to prevent the developer from leaking in an axial direction of the developer carrying member when the developer carrying member is mounted to the developing device frame unit, and a blade sealing member for providing a seal between the regulating member and the developing device frame to prevent the developer from leaking when the regulating member is mounted. The blade sealing member is an elastomer resin material which is injection-molded with a metal mold and which is provided in the seal forming portion where the one end sealing member and the other end sealing member are provided. The blade sealing member connects the one end sealing member and the other end sealing member with each other. The developing device frame unit also includes a protrusion provided by a squeezed-out portion of the elastomer resin material. The squeezed-out portion is provided by injecting, into a space defined by the metal mold, the seal forming portion, the one end sealing member and the other end sealing member, a volume of the elastomer resin material that is larger than the volume of the space.

According to another aspect of the present invention, there is provided a developing apparatus for developing an electrostatic latent image formed on an image bearing member. The apparatus comprises (i) a developer carrying member for developing the electrostatic latent image with a developer, (ii) a developer accommodating portion for accommodating the developer, (iii) a regulating member for regulating the layer thickness of the developer on the developer carrying member, and (iv) a developing device frame unit. The developing device frame unit includes a seal forming portion, a one end sealing member which is provided at one longitudinal end of the developing device frame and which is contactable to a surface of the developer carrying member to prevent the developer from leaking in an axial direction of the developer carrying member when the developer carrying member is mounted to the developing device frame unit, an other end sealing member which is provided at the other longitudinal end of the developing device frame and which is contactable to the surface of the developer carrying member to prevent the developer from leaking in an axial direction of the developer carrying member when the developer carrying member is mounted to the developing device frame unit, and a blade sealing member for providing a seal between the regulating member and the developing device frame to prevent the developer from leaking when the regulating member is mounted to the developing device frame unit. The blade sealing member is an elastomer resin material which is injection-molded with a metal mold and which is provided in the seal forming portion where the one end sealing member and the other end sealing member are provided. The blade sealing member connects the one end sealing member and the other end sealing member with each other. The developing device frame unit also includes a protrusion provided by a squeezed-out portion of the elastomer resin material. The squeezed-out portion is provided by injecting, into a space defined by the metal mold, the seal forming portion, the one end sealing member and the other end sealing member, a volume of the elastomer resin material that is larger than the volume of the space.

According to a further aspect of the present invention, there is provided a process cartridge detachably mountable to a main assembly of an image forming apparatus. The process cartridge comprises (i) an image bearing member, (ii) a developer carrying member for developing an electrostatic latent image formed on the image bearing member with a developer, (iii) a developer accommodating portion for accommodating the developer, (iv) a regulating member for regulating the layer thickness of the developer on the developer carrying member, and (v) a developing device frame unit. The developing device frame unit includes a developing device frame including a seal forming portion. The developing device frame unit also includes a one end sealing member which is provided at one longitudinal end of the developing device frame and which is contactable to a surface of the developer carrying member to prevent the developer from leaking in an axial direction of the developer carrying member when the developer carrying member is mounted to the developing device frame unit, an other end sealing member which is provided at the other longitudinal end of the developing device frame and which is contactable to the surface of the developer carrying member to prevent the developer from leaking in an axial direction of the developer carrying member when the developer carrying member is mounted to the developing device frame unit, and a blade sealing member for providing a seal between the regulating member and the developing device frame to prevent the developer from leaking when the regulating member is mounted to the developing device frame unit. The blade sealing member is an elastomer resin material which is injection-molded with a metal mold and which is provided in the seal forming portion where the one end sealing member and the other end sealing member are provided. The blade sealing member connects the one end sealing member and the other end sealing member with each other. The developing device frame unit also includes a protrusion provided by a squeezed-out portion of the elastomer resin material. The squeezed-out portion is provided by injecting, into a space defined by the metal mold, the seal forming portion, the one end sealing member and the other end sealing member, a volume of the elastomer resin material that is larger than the volume of the space.

According to a further aspect of the present invention, there is provided a manufacturing method for a developing device frame unit for supporting a regulating member for regulating the layer thickness of a developer on a developer carrying member. The method comprises a step of mounting a first end sealing member which is provided at one longitudinal end of the developing device frame and which is contactable to a surface of the developer carrying member to prevent the developer from leaking in an axial direction of the developer carrying member when the developer carrying member is mounted to the developing device frame unit, a step of mounting a second end sealing member which is provided at the other longitudinal end of the developing device frame and which is contactable to the surface of the developer carrying member to prevent the developer from leaking in an axial direction of the developer carrying member when the developer carrying member is mounted to the developing device frame unit, and a sealing member molding step of molding a blade sealing member for providing a seal between the regulating member and the developing device frame to prevent the developer from leaking when the regulating member is mounted to the developing device frame unit. The blade sealing member is an elastomer resin material which is injection-molded with a metal mold and which is provided in the seal forming portion where the first end sealing member and the second end sealing member are provided. The blade sealing member connects the first end sealing member and the second end sealing member with each other. The molding step includes providing a protrusion provided by a squeezed-out portion of the elastomer resin material. The squeezed-out portion is provided by injecting, into a space defined by the metal mold, the seal forming portion, the first end sealing member and the second end sealing member, a volume of the elastomer resin material larger than a volume of the space.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, a developing device frame unit, a developing device, a process cartridge, and a manufacturing method of the developing device frame unit will be described more specifically with reference to the drawings.

Embodiment 1

Figure 1:
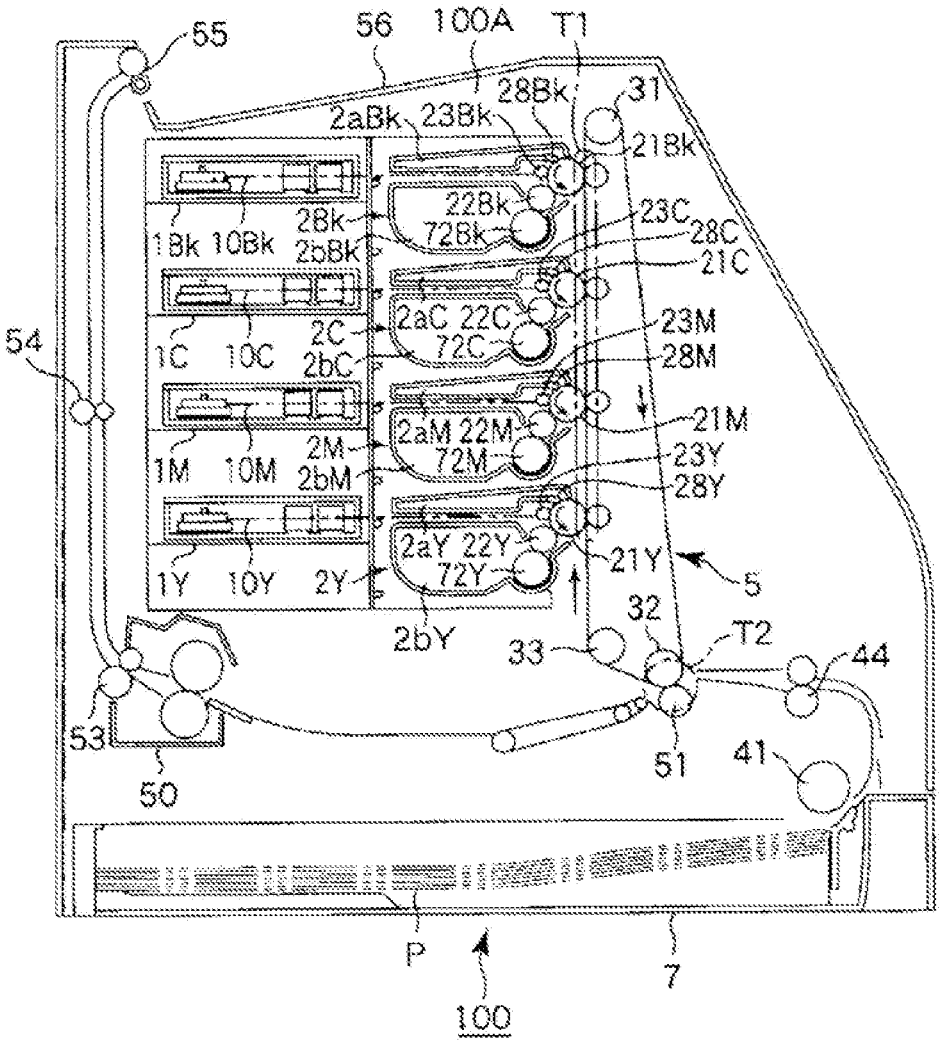
FIG. 1 is a schematic sectional view showing a general arrangement in an embodiment of an image forming apparatus to which a developing device frame unit, a developing device, and a process cartridge according to the present invention is applicable.

FIG. 1 shows a general arrangement of a color laser beam printer, using an electrophotographic process, as an embodiment of an image forming apparatus to which the present invention is to be applied.

(General Arrangement)

In this embodiment, the image forming apparatus 100 includes four independent process cartridges 2 (2Y, 2M, 2C, 2Bk) which are detachably mountable to an apparatus main assembly 100A and are arranged vertically. In this embodiment, the process cartridges 2 (2Y, 2M, 2C and 2Bk) include image forming means for yellow (Y) toner, magenta (M) toner, cyan (C) toner, and black (Bk) toner, respectively. In the following description, a "longitudinal direction" of the process cartridge means a direction substantially perpendicular to a direction in which the process cartridge is mounted into the main assembly 100A of the image forming apparatus 100 (i.e., a rotational axis direction of a photosensitive drum). Further, a "left (side)" and a "right (side)" are those of the process cartridge as seen from a side from which the process cartridge is inserted into the apparatus main assembly 100A. Further, an "upper surface" of the process cartridge is a surface of the process cartridge located at an upper portion thereof in a mounted state of the process cartridge into the apparatus main assembly 100A and a "lower surface" of the process cartridge located at a lower portion thereof in the mounted state.

The process cartridges 2 (2Y, 2M, 2C, 2Bk) includes rotation drum-type electrophotographic photosensitive members 21 (21Y, 21M, 21C, 21Bk), respectively, as an image bearing member (hereinafter referred to as "photosensitive drum(s)"). Around the respective photosensitive drums 21, charging rollers 23 (23Y, 23M, 23C, 23Bk) as a charging means and developing units 2*b* (2*b*Y, 2*b*M, 2*b*C, 2*b*Bk) constituting a developing means are disposed. Further, around the respective photosensitive drums 21, cleaning units 2*a* (2*a*Y, 2*a*M, 2*a*C, 2*a*Bk) including cleaning blades 28 (28Y, 28M, 28C, 28Bk) as a collecting means are disposed.

As described above, in this embodiment, the photosensitive drum 21 is integrally mounted together with the charging roller 23 to the cleaning unit 2*a* provided with the cleaning blade 28. That is, the cleaning unit 2*a* also functions as a photosensitive drum unit.

In this embodiment, the developing unit 2*b* and the photosensitive drum unit 2*a* including the photosensitive drum 21, the charging roller 23 and the cleaning blade 28 are integrally supported to constitute the process cartridge 2 (2Y, 2M, 2C, 2Bk). The process cartridges 2 (2Y, 2M, 2C, 2Bk) for four colors are configured to be independently detachably mountable to the printer main assembly 100A.

Developer images different in color formed by the process cartridges 2 (i.e., toner images) are successively transferred onto an intermediary transfer belt as an intermediary transfer member constituting a transferring device 5 in a superposition manner. As a result, full-color images are formed on the intermediary transfer belt. The intermediary transfer belt is extended around rollers 31, 32 and 33 provided to the transferring device 5.

A transfer material P is fed from a sheet feeding cassette 7 disposed at a lower portion of the image forming apparatus 100 and then is conveyed vertically, so that the full-color images are simultaneously transferred from the intermediary transfer belt onto the transfer material P. Then, the transfer material P is subjected to fixing by a fixing device 50 and then is discharged on a sheet discharge tray 56 through sheet discharge rollers 53, 54 and 55.

(Image Forming Operation)

An operation for carrying out image formation by the above-constituted image forming apparatus will be described.

First, a sheet feeding roller 41 is rotated to separate one sheet of the transfer material P from those in the sheet feeding cassette 7 and then conveys the separated sheet to registration rollers 44.

The photosensitive drum 21 and the intermediary transfer belt rotate in indicated arrow directions at predetermined outer peripheral speeds (process speeds) V, respectively. The photosensitive drum 21 uniformly charged by the charging roller 23 is exposed to a laser beam (10Y, 10M, 10C, 10Bk) from a scanner portion as the exposure device (1Y, 1M, 1C, 1Bk).

The image forming operations for the respective colors are similar to each other, so that only the image forming operation for a yellow image will be described in this embodiment.

(Formation of Yellow Image)

The scanner portion 1Y irradiates the surface of the photosensitive drum 21Y with the laser beam 10Y for a yellow image to form a yellow latent image. At the same time as the latent image formation, the yellow developing unit 2*b*Y is driven to develop the latent image on the photosensitive drum 21Y with the yellow toner. Then, at a primary transfer portion T1 located downstream of the developing portion, the yellow toner image is primary-transferred from the photosensitive drum 21Y onto an outer peripheral surface of the intermediary transfer belt.

In the same manner as described above, also with respect to a magenta image, a cyan image, and a black image, the latent image formation, the development, and the primary transfer of the toner image are performed to form full-color images of four types of yellow, magenta, cyan and black on the surface of the intermediary transfer belt.

A bias is applied to a transfer roller 51 simultaneously with press-contact of the intermediary transfer belt, on which the full-color images are formed after the completion of the primary transfer of the fourth black toner image, with the transfer material P at a secondary transfer position T2. As a result, the full-color images for four colors, on the intermediary transfer belt are simultaneously transferred onto the transfer material P. Thereafter, the transfer material P is separated from the intermediary transfer belt and then is conveyed to the fixing device 50. Thereafter, the transfer material P is discharged, with an image-formed surface down, on the sheet discharge tray 56 at the upper portion of the main assembly 100A through the sheet discharge rollers 53, 54 and 55.

(Process Cartridge Constitution)

Next, the process cartridges 2 (2Y, 2M, 2C, 2Bk) in this embodiment will be described in detail with reference to FIG. 2.

Figure 2:
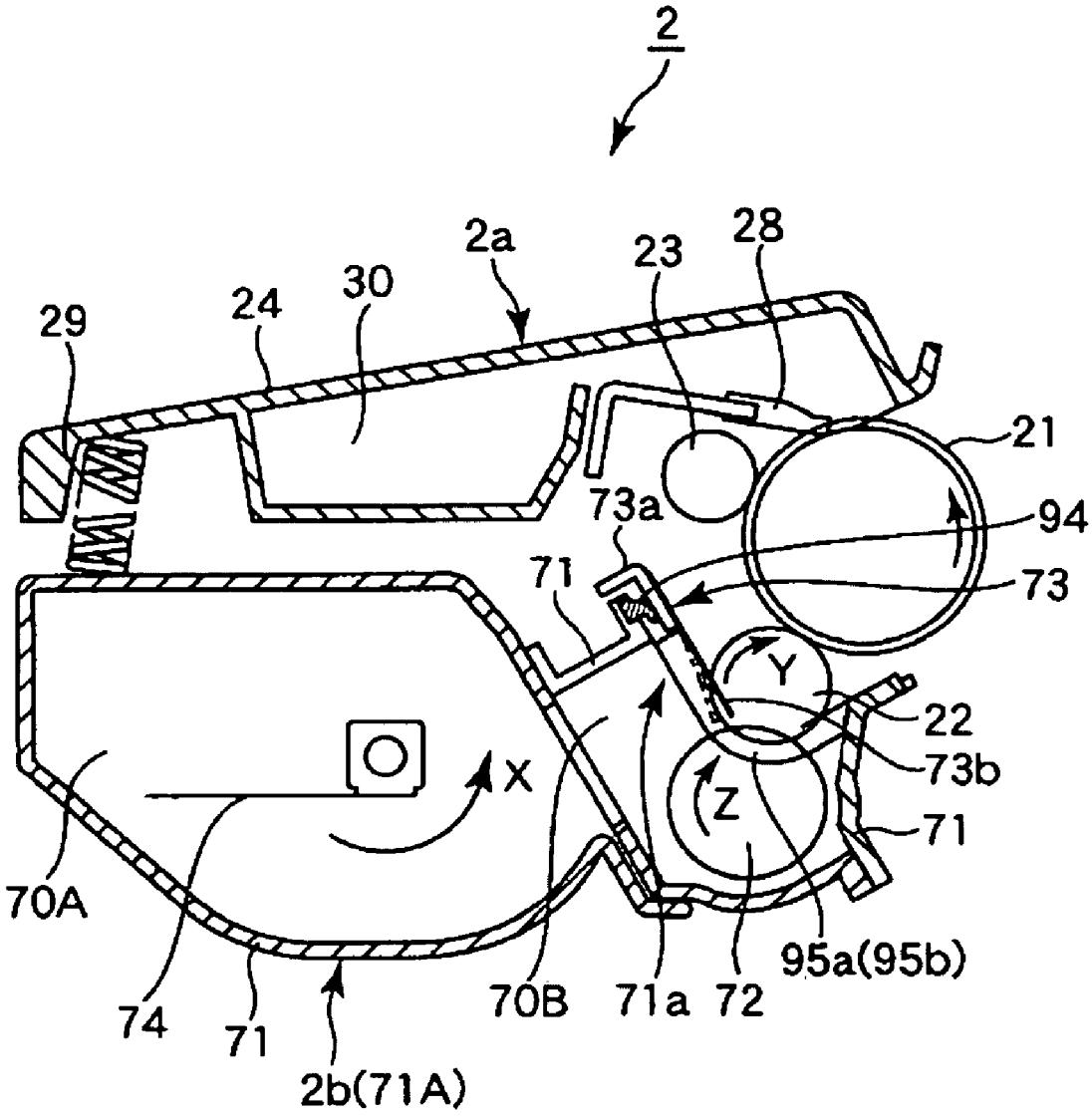
FIG. 2 is a schematic sectional view showing an embodiment of the process cartridge of the present invention.

FIG. 2 is a schematic sectional view of the process cartridge 2. The respective process cartridges for yellow, magenta, cyan and black have the same constitution. Therefore, in the following description, suffixes Y, M, C and Bk representing the respective colors are omitted and the process cartridges 2 (2Y, 2M, 2C, 2Bk) for the respective colors are collectively described as the process cartridge 2.

The process cartridge 2 is, as described above, separated into the cleaning unit, i.e., the photosensitive drum unit 2*a* and the developing unit 2*b*. The photosensitive drum unit 2*a* includes the photosensitive drum 21, the charging roller 23 as the charging means, and the cleaning blade 28 as the cleaning means. The developing unit 2*b* constitutes the developing device (developing means) for developing the electrostatic latent image formed on the photosensitive drum 21.

More specifically, the photosensitive drum unit 2*a* includes the photosensitive drum 21 which is rotatably mounted to the cleaning frame 24. On the peripheral surface of the photosensitive drum 21, the charging roller 23 as the primary charging means for electrically charging the surface of the photosensitive drum 21 uniformly and the cleaning blade 28 for removing the developer (toner) remaining on the surface of the photosensitive drum 21 are disposed. Residual toner removed from the surface of the photosensitive drum 21 by the cleaning blade 28 is collected in a residual toner chamber 30 provided at a rear portion of the cleaning frame 24. The photosensitive drum 21 is supplied with a driving force transmitted from an unshown driving motor to be rotationally driven counterclockwise (in a direction indicated by an arrow) depending on the image forming operation.

The developing unit 2*b* is constituted by the toner container 70A as the developer accommodating portion in which the developer (toner) is accommodated and the developing container 70B which rotatably supports the developing roller 22 as the developer carrying member. The toner container 70A and the developing container 70B are integrally formed by the developing device frame 71 consisting of a plurality of frame members.

The developing roller 22 rotates in contact with the photosensitive drum 21 in a direction of the arrow Y. On the peripheral surface of the developing roller 22, the toner supplying roller 72 rotating in contact with the developing roller 22 and the developing blade unit 73 are disposed.

The developing roller 22 and the developing blade unit 73 are integrally mounted to the developing device frame 71 through end seal members 95*a* and 95*b* and a blade seal member 94 provided to the developing device frame 71 constituting the developing container 70B. As a result, the leakage of the toner contained in the developing container 70B to the outside is obviated. The developing device frame 71, the end seal members 95*a* and 95*b*, and the blade seal member 94 are integrally formed to constitute the developing device frame unit 71A. To the developing device frame unit 71A, as described later, the developing blade unit 73, the developing roller 22, the toner supplying roller 72, and the like are mounted, thus constituting the developing unit 2*b*.

The developing blade unit 73 includes a developing blade 73*b* as a regulating member for regulating an amount of toner no the developing roller 22 and a supporting plate 73*a* for supporting the developing blade 73*b* and is mounted to the developing device frame unit 71A constituting the developing container 70B. Details of the developing device frame unit 71A and the developing blade unit 73 will be described later.

In the toner container 70A, a toner stirring mechanism 74 for stiffing the accommodated toner and conveying the toner to the toner supplying roller 72 is provided. The developing unit 2*b* is urged by an urging spring 29 so that the developing roller 22 contacts the photosensitive drum 21.

During the development, the accommodated toner is conveyed to the toner supplying roller 72 by the toner stirring mechanism 74 which is rotationally driven in an arrow X direction. As a result, the toner supplying roller 72 rotating in the arrow Z direction rubs against the developing roller 22 rotating in the arrow Y direction to supply the toner to the developing roller 22. The toner carried on the developing roller 22 reaches the developing blade unit 73 by the rotation of the developing roller 22 and is regulated by the developing blade unit 73, so that a desired amount of electric charge is imparted to the toner and at the same time, the toner is formed in a predetermined thin layer. The regulated toner is conveyed by the rotation of the developing roller 22 to the developing portion at which the photosensitive drum 21 and the developing roller 22 contact each other. At the developing portion, the toner is transferred onto the surface of the photosensitive drum 21 by a DC developing bias applied from an unshown power source to the developing roller 22.

(Seal Constitution of Developing Device Frame Unit)

Next, a seal constitution of the developing device frame unit 71A in this embodiment will be described with reference to FIG. 3 to FIGS. 8(*a*) and 8(*b*).

Figure 3:
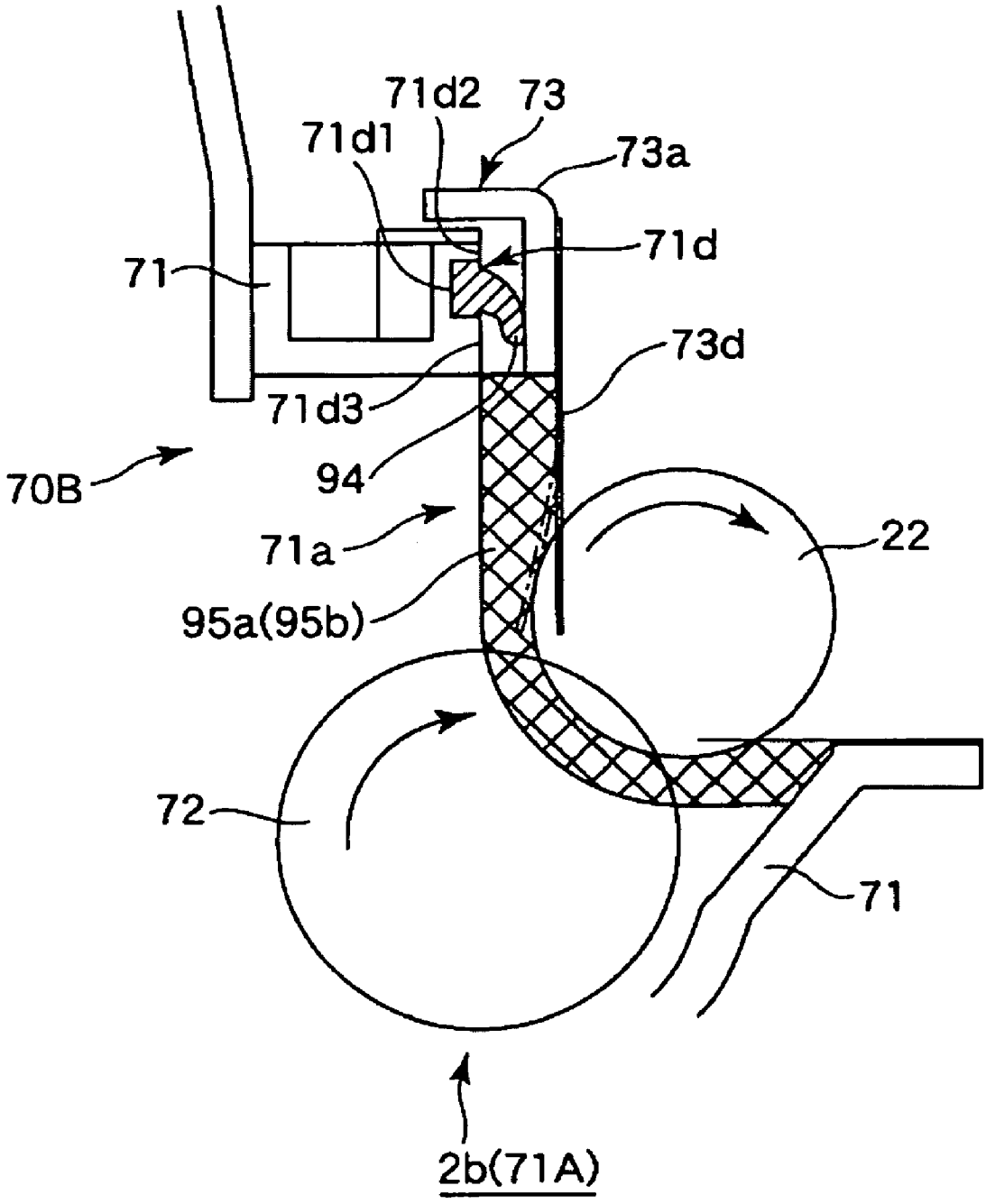
FIG. 3 is a partial schematic sectional view of the developing device frame unit of the present invention.
Figure 4:
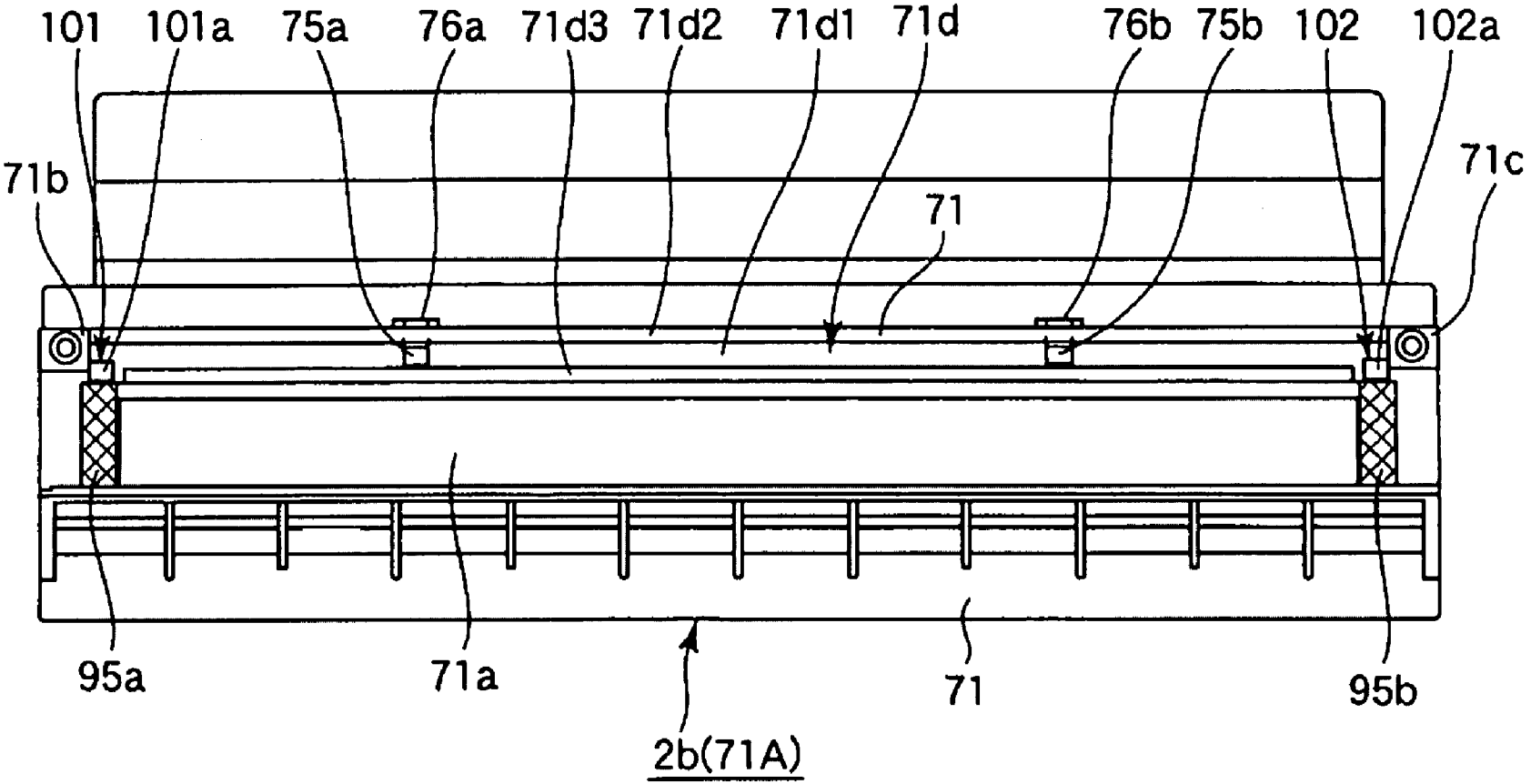
FIG. 4 is a schematic front view showing a state before an under blade seal of the developing device frame unit of the present invention is formed.
Figure 5:
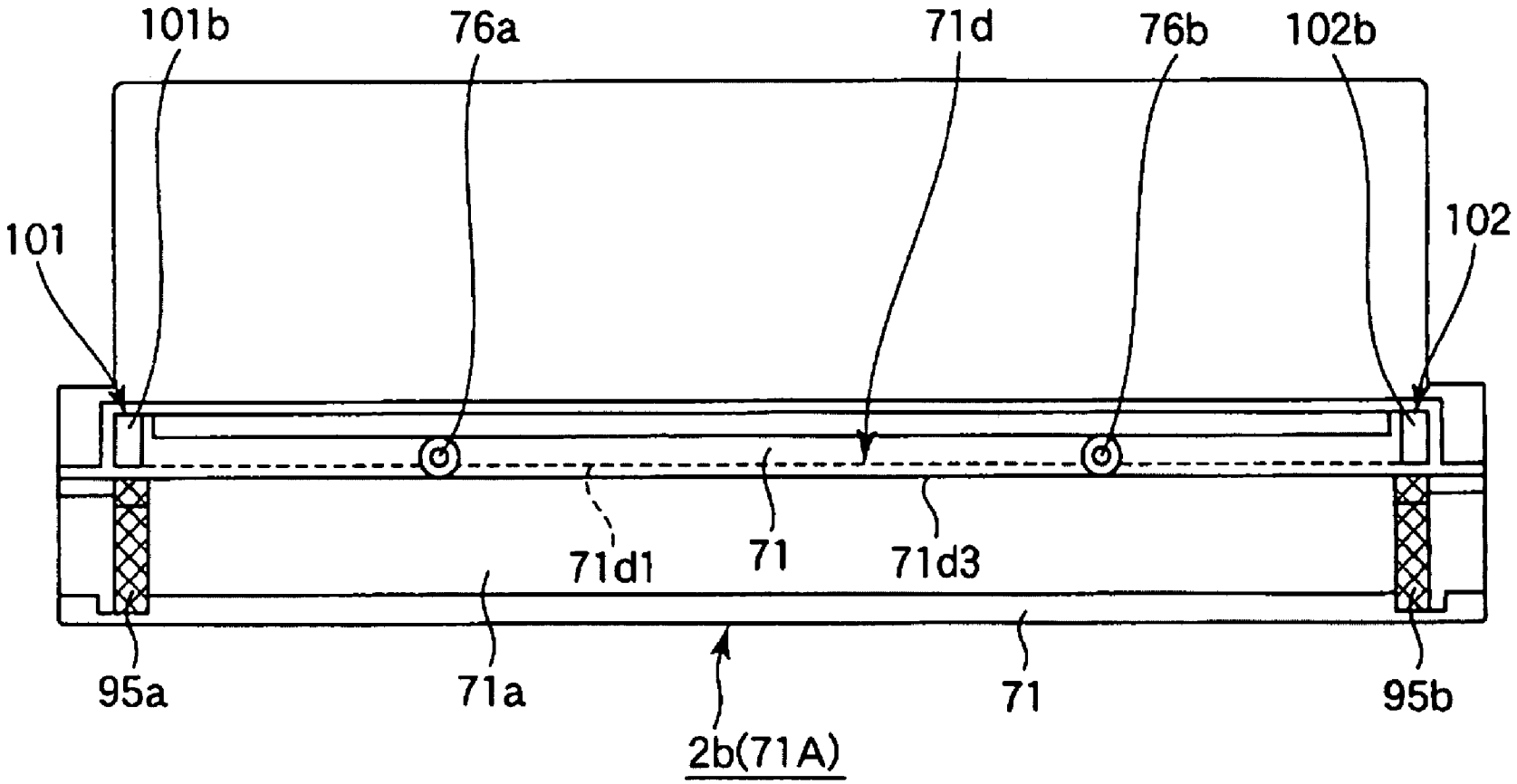
FIG. 5 is a schematic top plan view showing a state before the under blade seal of the developing device frame unit for a developing unit in the present invention is formed.
Figure 6:
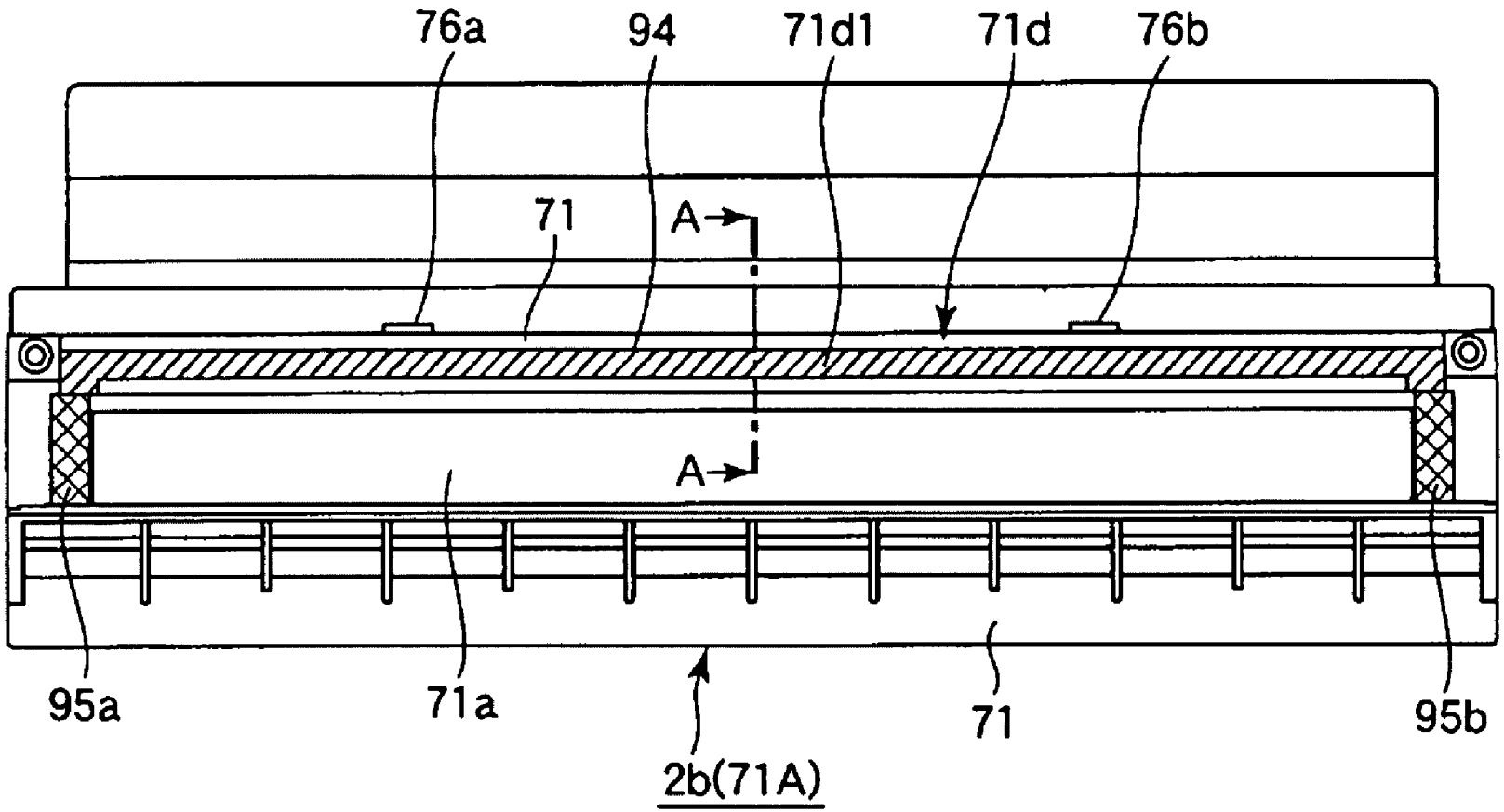
FIG. 6 is a schematic front view showing a state before the under blade seal of the developing device frame unit for the developing unit in the present invention is formed.
Figure 7:
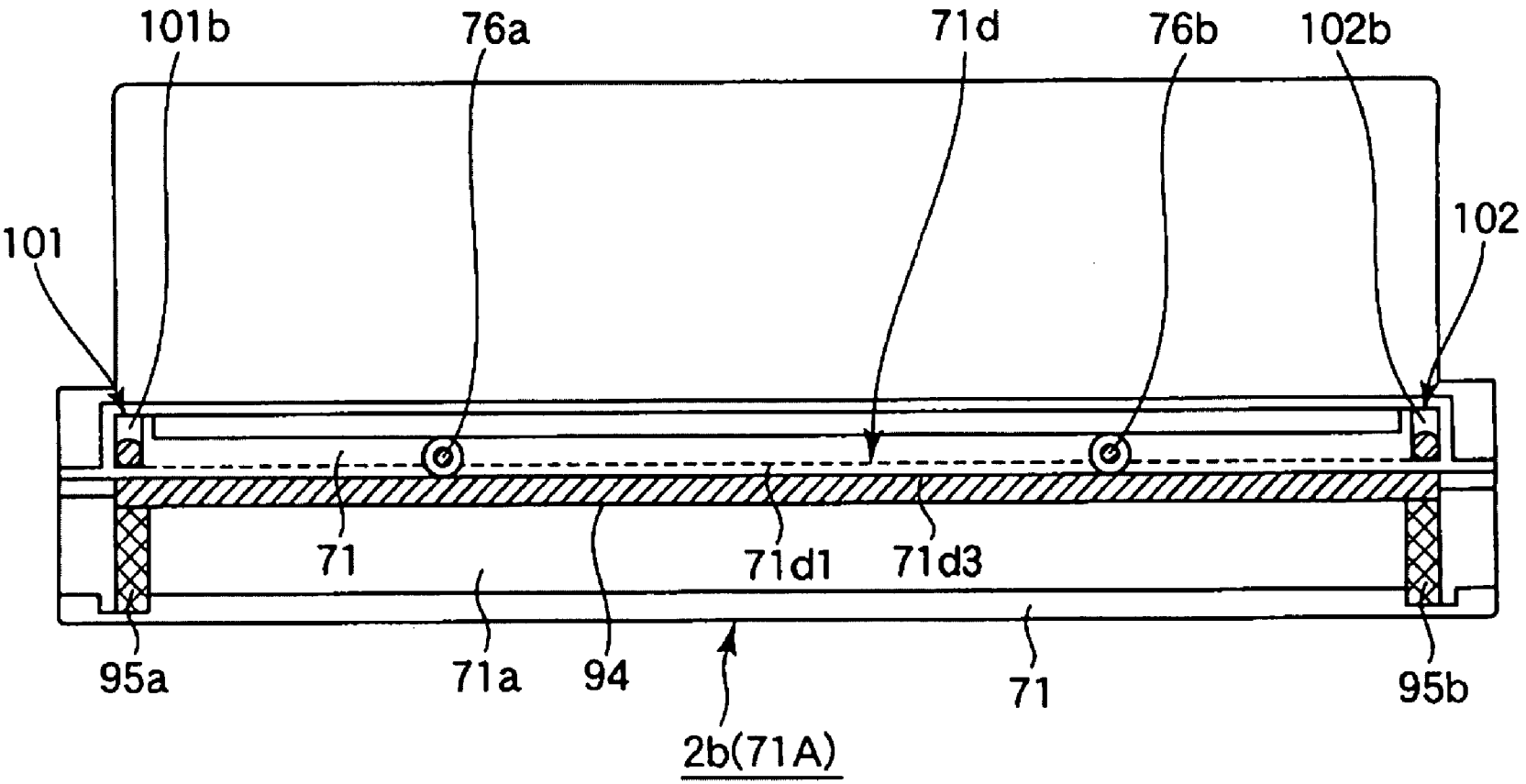
FIG. 7 is a schematic top plan view showing a state before the under blade seal of the developing device frame unit for the developing unit in the present invention is formed.
Figure 8:
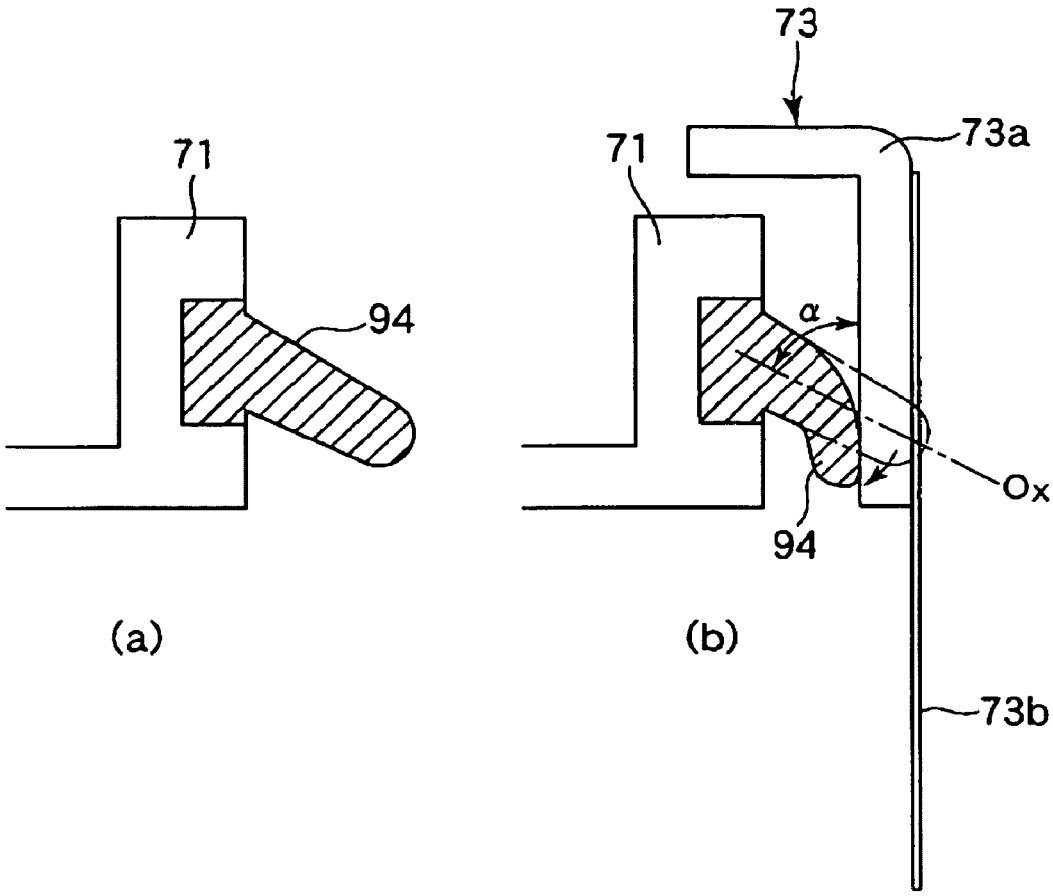
FIGS. 8(*a*) and 8(*b*) are schematic sectional views showing an embodiment of the under blade seal taken along A-A line indicated in FIG. 6.

FIG. 3 is a schematic sectional view showing a seal constitution of the developing device frame unit 71A in the developing unit 2*b* in this embodiment. FIG. 4 is a schematic front view showing the developing device frame unit 71A in a state before ejection molding of the under blade seal (blade seal member) 94 and FIG. 5 is a schematic top plan view showing the developing device frame unit 71A in a state before the ejection molding of the under blade seal 94. FIG. 6 is a schematic front view showing the developing device frame unit 71A in a state after the ejection molding of the under blade seal 94 and FIG. 7 is a schematic top plan view showing the developing device frame unit 71A in a state after the ejection molding of the under blade seal 94. In FIG. 4 to FIG. 7, the developing blade unit 73 is omitted. FIG. 8 is a schematic sectional view showing the under blade seal 94 in this embodiment.

As shown in FIG. 3, the developing container 70B has a developing opening 71*a* for supplying the toner contained in the toner container 70A to the developing roller 22. The developing roller 22 and the developing blade unit 73 for regulating the amount of toner on the developing roller 22 are disposed in the neighborhood of the developing opening 71*a*.

The developing blade unit 73 in this embodiment is constituted by connecting the supporting plate 73*a* of a steel plate with the developing blade 73*b* of a stainless steel plate or a phosphor bronze plate. The supporting plate 73*a* is locked and supported, with screws or the like, at locking portions 71*b* and 71*c* (FIG. 4) provided at both end portions of the developing device frame 71 constituting the developing container 70B. The developing blade 73*b* may also be prepared by integrally forming the supporting plate 73*a* with a rubber material or the like.

As shown in FIG. 3 to FIG. 5, at both longitudinal end portions of the developing opening 71*a*, the end seal members 95*a* and 95*b* for sealing the gap between the developing container 70B and the peripheral surface of the developing roller 22 are disposed. The end seal members 95*a* and 95*b* are a flexible member of a pile, an electrostatic flocking material, or the like, having a surface at which a felt or fiber is woven. In this embodiment, the end seal members 95*a* and 95*b* cause the peripheral surface of the developing roller 22 and the back surface of the developing blade 73*b* of the developing blade unit 73 to press-contact each other when the developing roller 22 and the developing blade unit 73 are mounted to the developing device frame 71. As a result, in the developing unit 2*b*, the sealing property for the developing roller 22 with respect to an axial direction is maintained.

At an upper portion of the developing opening 71*a* of the developing container 70B, the developing device frame 71 is provided with a seal forming portion 71*d* between one end seal member 95*a* and the other end seal member 95*b*. The seal forming portion 71*d* includes a recess 71*d*1 into which the under blade seal 94 of an elastomer resin material is to be injected and contact surfaces 71*d*2 and 71*d*3 at which a mold contacts the contact surfaces.

Figure 10:
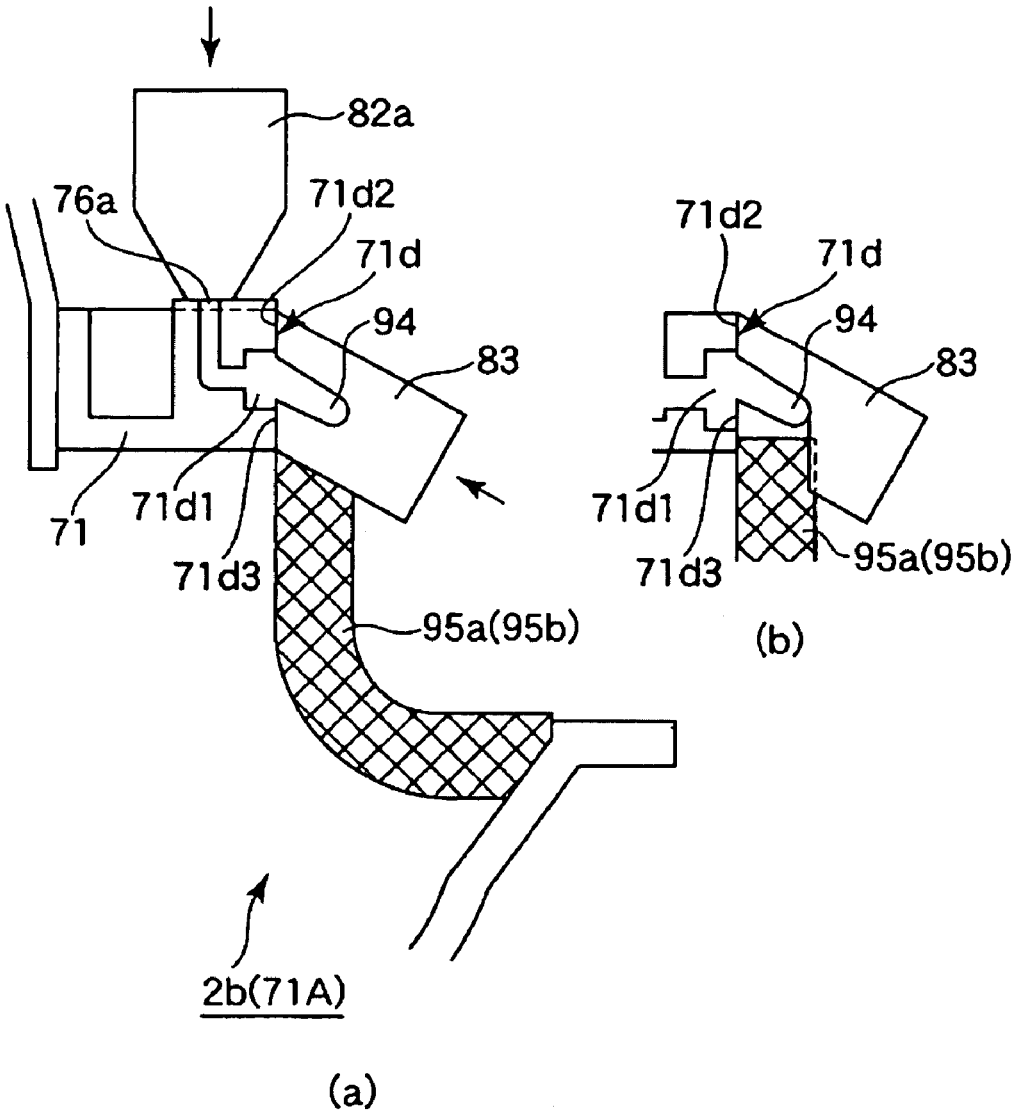
FIGS. 10(*a*) and 10(*b*) are schematic sectional views, taken along B-B line indicated in FIG. 12, showing a resin material injecting portion in a state in which a seal mold for the developing device frame unit in the developing unit in the present invention is subjected to clamping.

As is well understood with reference to FIGS. 10(*a*), 10(*b*) and 11, at predetermined positions of the developing device frame 71 with respect to a longitudinal direction, cylindrical injection ports 76*a* and 76*b* communicating with the recess 71*d*1 of the seal forming portion 71*d* at hole portions 75*a* and 75*b* are provided. In this embodiment, the injection ports 76*a* and 76*b* are provided at two positions which are equidistantly located from a center of the seal forming portion 71*d* with respect to a longitudinal direction of the seal forming portion 71*d* but may also be formed at one position located at the center or formed at three or more positions.

Figure 13:
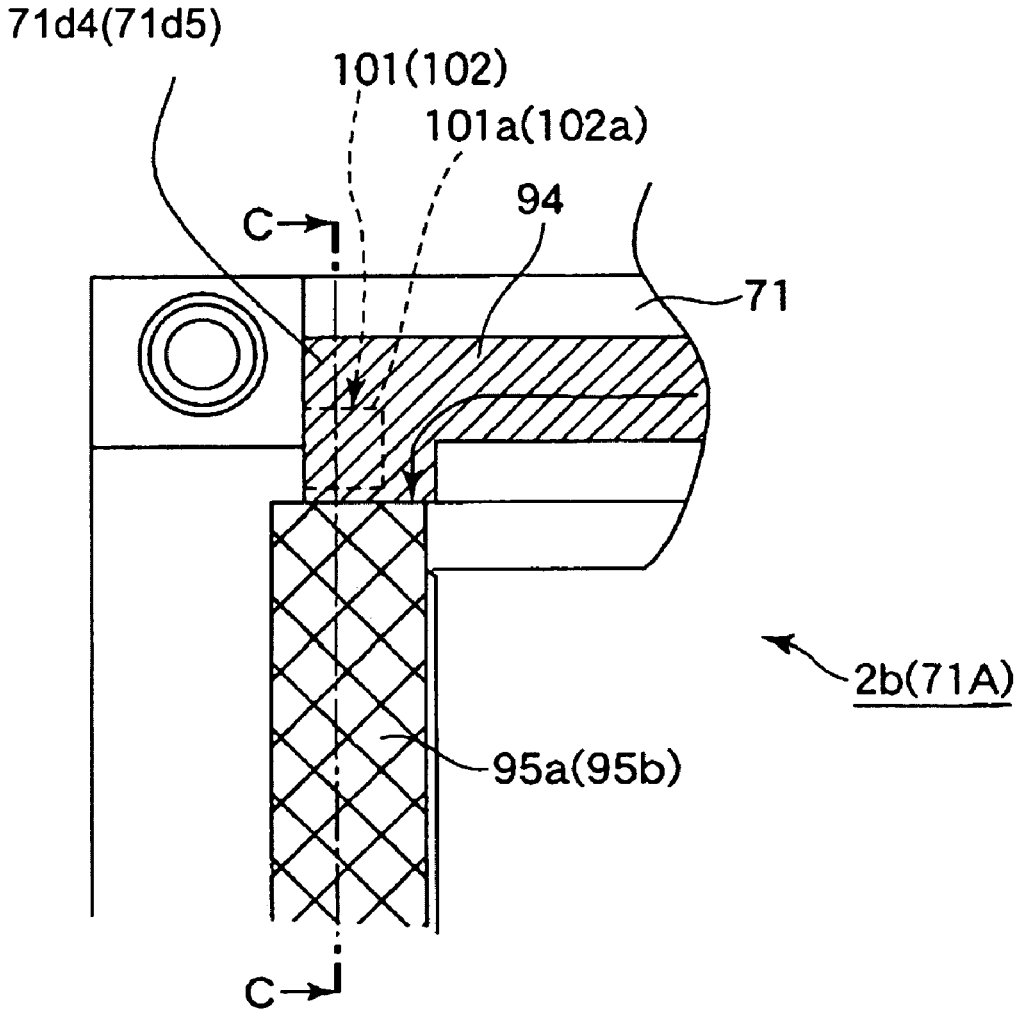
FIG. 13 is a schematic front view showing a longitudinal end portion in a state in which the under blade seal is molded.

As is well understood with reference to FIGS. 4, 5, 7, 13 and 14, a buffer portion 101 is provided, on a back side of the seal forming portion 71*d*, between the injection port 76*a* and one end seal member 95*a*. This buffer portion 101 is constituted by a communication port 101*a* and a resin material reservoir portion 101*b* and is connected to the recess 71*d*1 of the seal forming portion 71*d* at the communication port 101*a*. Similarly, a buffer portion 102 constituted by a communication port 102*a* and a resin material reservoir portion 102*b* is provided, on the back side of the seal forming portion 71*d*, between the injection port 76*b* and the other end seal member 95*b*. The buffer portion 102 is also connected to the recess 71*d*1 of the seal forming portion 71*d* at the communication port 102*a*. In this embodiment, the buffer portions 101 and 102 are located in the neighborhood of the end seal members 95*a* and 95*b*, respectively. Specifically, as shown in FIG. 13, the buffer portion 101 (102) is provided at a position at which the buffer portion 101 (102) overlaps with the end seal member 95*a* (95*b*) with respect to a direction perpendicular to a longitudinal direction of the developing roller 22. Further, the buffer portion 101 (102) is provided at a bent portion (corner portion) 71*d*4 (71*d*5) at which the elastomer resin material injected from the injection port 76*a* (76*b*) flows along the longitudinal direction of the developing roller 22 and then changes in its flow direction toward the end seal member 95*a* (95*b*). Further, the buffer portion 101 (102) may also be provided between the bent portion 71*d*4 (71*d*5) and the end seal member 95*a* (95*b*). As a result, the elastomer resin material can be sufficiently brought into contact with the end seal member 95*a* (95*b*), thus ensuring close contact between the end seal member 95*a* (95*b*) and the under blade seal 94.

As shown in FIG. 6 and FIG. 7, the under blade seal 94 as the blade seal member is provided in the recess 71*d*1 of the seal forming portion 71*d* constituting the developing device frame 71. The under blade seal 94 retains the sealing property so as to prevent the toner from leaking from the gap between the developing device frame 71 (i.e., developing device frame unit 71A) and the developing blade unit 73 to the outside of the developing unit 2*b*. Further, the under blade seal 94 closely seals up the gap between the under blade seal 94 and one end seal member 95*a* and the gap between the under blade seal 94 and the other end seal member 95*b* with respect to the longitudinal direction of the under blade seal 94.

As shown in FIGS. 8(*a*) and 8(*b*), the under blade seal 94 has a lip-like cross-section shape such that a center axis Ox of the under blade seal 94 is inclined from a seal contact surface by an angle $\alpha$. Further, in a state in which the developing blade unit 73 is mounted to the developing device frame 71, as shown in FIG. 8(*b*), the under blade seal 94 is deformed so as to be bent between the developing device frame 71 and the developing blade unit 73, thus ensuring sealing so as not to cause toner leakage.

Figure 9:
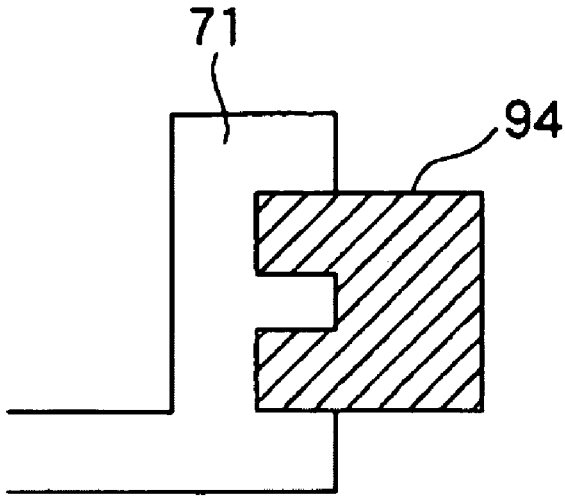
FIGS. 9(*a*) and 9(*b*) are schematic sectional views showing another embodiment of the under blade seal taken along A-A line indicated in FIG. 6.
Figure 9:
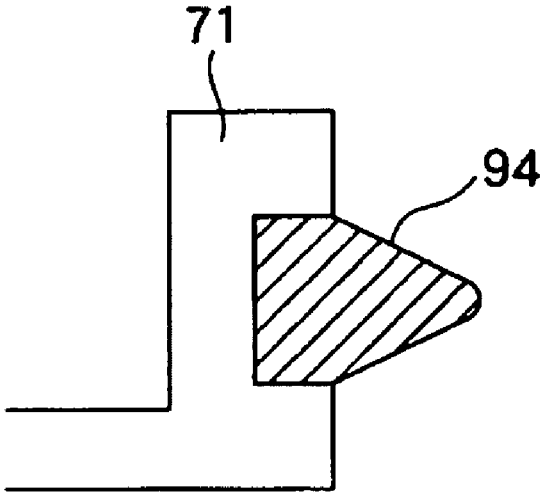

In this embodiment, in order to decrease a repelling force of the under blade seal 94 against the developing blade unit 73 as small as possible, the under blade seal 94 is formed in the lip-like shape so as to be bent. However, as shown in FIGS. 9(*a*) and 9(*b*), the cross-sectional shape of the under blade seal 94 may also be a rectangular shape (FIG. 9(*a*)) or a triangular shape (FIG. 9(*b*)) so as to be subjected to compression deformation with a predetermined compression amount.

The under blade seal 94 is integrally formed, of an elastic seal member, with the developing device frame 71 by ejection molding. In this embodiment, a material (an elastic seal material) for the under blade seal 94, the elastomer resin material is used. As the elastomer resin material, a styrene-based elastomer resin material which is identical to that for the developing device frame 71 and has elasticity may preferably be used since it is excellent in disassembling operability during recycling of the process cartridge (i.e., disassembling between parts is not required if the parts are formed of the same material). However, other elastomer resin materials may also be used so long as the elastomer resin materials have the same mechanical characteristic. Further, a silicone rubber or a soft rubber may also be employed. In this embodiment, the above-described various elastomer resin material sand rubbers as the elastic seal material are inclusively referred to as the "elastomer resin material").

(Seal Molding Step)

A step of molding the under blade seal 94 will be described with reference to FIGS. 10(*a*), 10(*b*), 11, 12, 13, 14 and 15.

Figure 11:
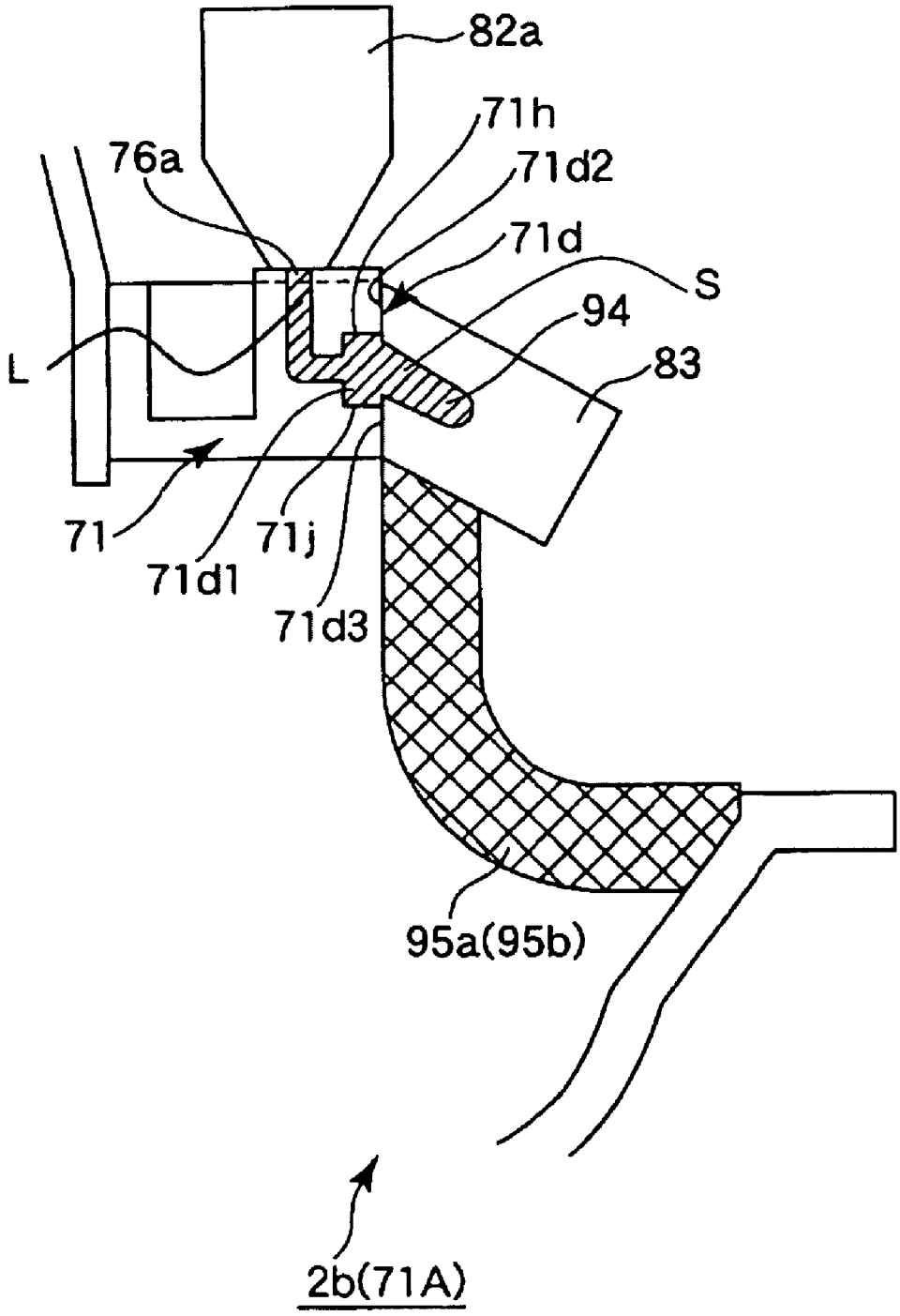
FIG. 11 is a schematic sectional view, taken along B-B line indicated in FIG. 12, showing a state of the under blade seal of the developing device frame unit for the developing unit in the present invention during molding.
Figure 12:
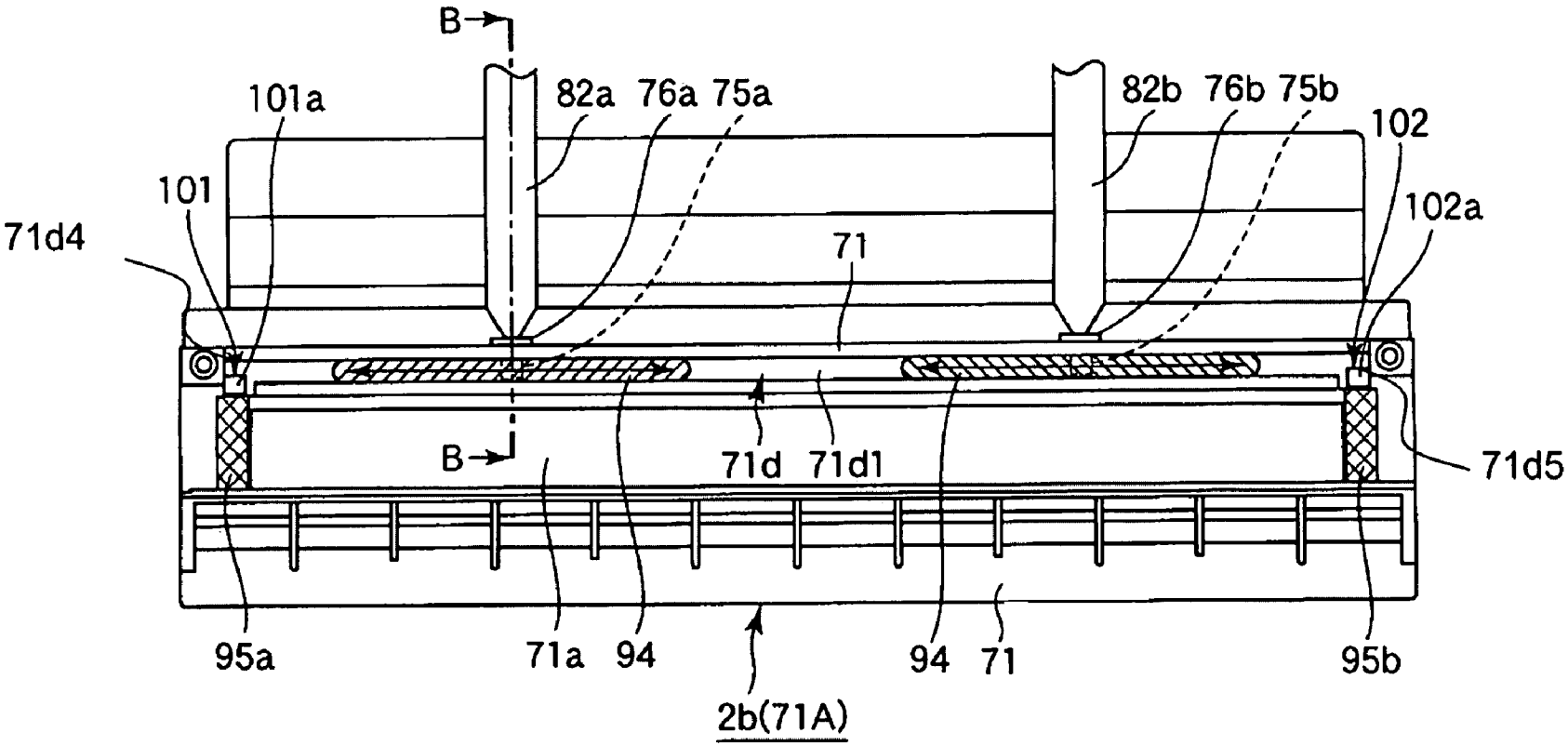
FIG. 12 is a schematic front view showing the developing unit during molding of the under blade seal.
Figure 14:
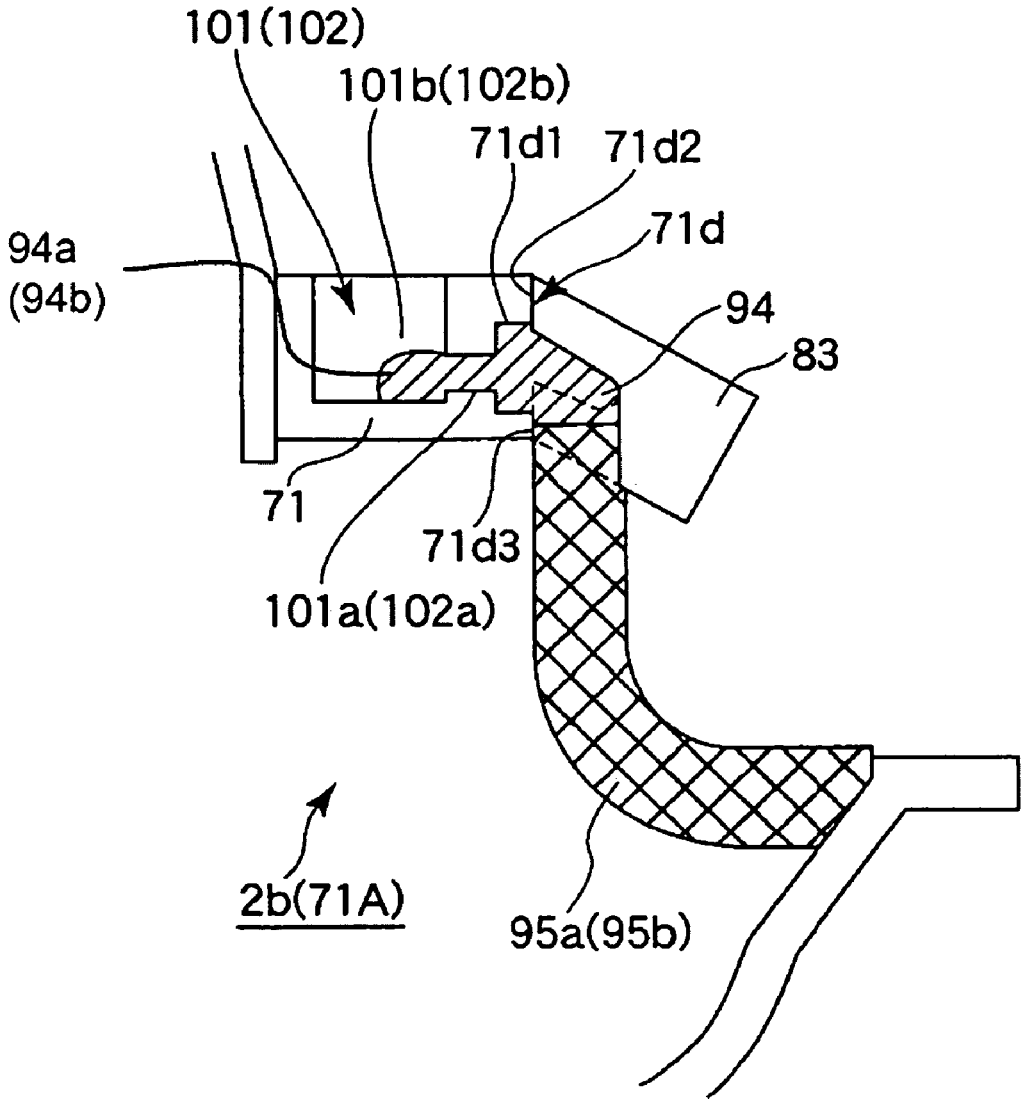
FIG. 14 is a schematic sectional view, taken along C-C line indicated in FIG. 13, showing the longitudinal end portion in a state in which the under blade seal is molded.
Figure 15:
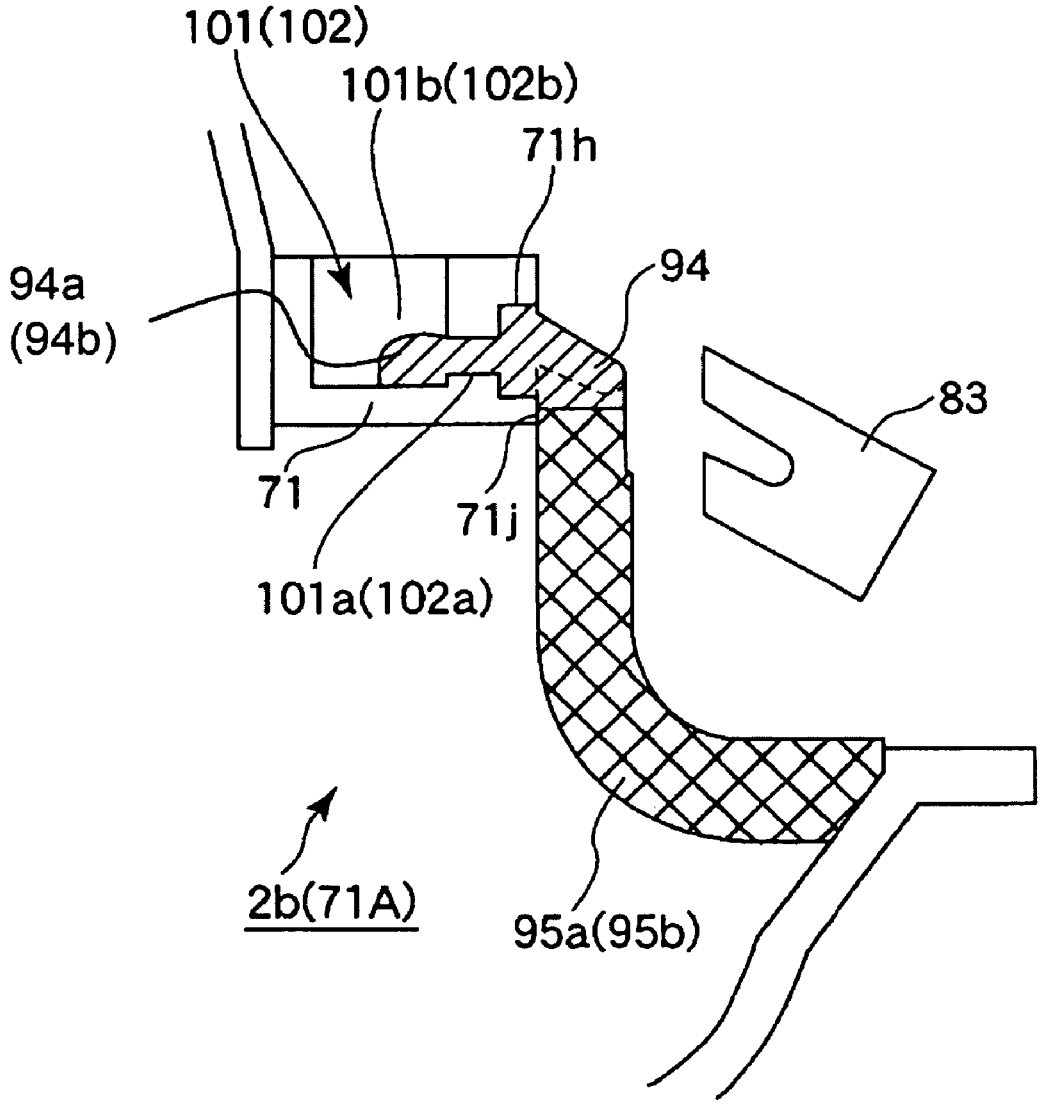
FIG. 15 is a schematic sectional view, taken along C-C line indicated in FIG. 13, showing a buffer portion of the developing unit.

FIGS. 10(*a*) and 10(*b*) are schematic sectional views showing a resin material injecting portion in a state in which a seal mold is clamped to the developing device frame 71 of the developing device frame unit 71A. FIG. 11 is a schematic sectional view showing the developing device frame unit 71A in this embodiment during molding of the under blade seal 94. FIG. 12 is a schematic front view showing the developing device frame unit 71A during the molding of the under blade seal 94. FIG. 13 is a schematic front view showing a longitudinal end portion of the developing device frame unit 71A in a state the under blade seal 94 in the present invention is molded. FIG. 14 is a schematic sectional view showing a buffer portion of the developing device frame unit 71A in this embodiment. FIG. 15 is a schematic sectional view showing the resin material injecting portion in a state in which the seal mold is removed from the developing device frame unit 71A in this embodiment.

First, the end seal members 95*a* and 95*b* are assembled on one end side and the other end side with respect to a longitudinal direction of the developing device frame 71 constituting the developing container 70B. Then, as shown in FIG. 10(*a*), a seal mold 83 with a recess corresponding to the shape of the under blade seal 94 is brought into contact with the contact surfaces 71*d*2 and 71*d*3 of the seal forming portion 71*d* of the developing device frame 71 to be clamped to the contact surfaces 71*d*2 and 71*d*3. At this time, the end seal members 95*a* and 95*b* on one end side and the other end side are, as shown in FIG. 10(*b*), placed in a compression-deformed state in a predetermined compression amount by the seal mold 83, so that the seal mold 83 and the end seal members 95*a* and 95*b* also closely contact each other with no gap. Then, gates 82*a* and 82*b* of a resin material injecting device are brought into contact with the injection ports 76*a* and 76*b*, provided at two positions of the developing device frame 71 with respect to the longitudinal direction of the developing device frame 71, from above. Then, the elastomer resin material as the seal material for the under blade seal 94 is injected from the gates 82*a* and 82*b* to the injection ports 76*a* and 76*b*. As a result, as shown in FIG. 11, the elastomer resin material is caused to flow into a space S defined by the recess 71*d*1 of the seal forming portion 71*d*, the seal mold 83, and the end seal members 95*a* and 95*b*.

The elastomer resin material injected from the longitudinal two positions flows in the space S, as shown in FIG. 12, toward both longitudinal ends of the developing device frame 71.

The elastomer resin material flowing in the longitudinal direction reaches the end seal member 95*a* (95*b*) provided at the both end portions as shown in FIG. 13 and sufficiently contact the end seal member 95*a* (95*b*) with no gap. Thereafter, as shown in FIG. 14, an excessive portion 94*a* (94*b*) of the elastomer resin material flows from the recess 71*d*1 into the resin material reservoir portion 101*b* (102*b*) through the communication port 101*a* (102*a*) of the buffer portion 101 (102), and therefore, the excessive portion 94*a* (94*b*) forms a protrusion of the elastomer resin material. The ejection is completed when the elastomer resin material flows into the resin material reservoir portion 101*b* (102*b*).

In this embodiment, a quantitative control method in which the elastomer resin material is injected in an amount ensuring flowing of the elastomer resin material into the buffer portions 101 and 102 with reliability is employed. That is, the amount of the elastomer resin material injected is more than the sum of the volume of a linear portion L extending from the injection port 76*a* to the recess 71*d*1 and the volume of the space S. For that purpose, the injection amount of the elastomer resin material is set at an amount such that the excessive portion 94*a* (94*b*) of the elastomer resin material flows into the resin material reservoir portion 101*b* (102*b*) through the communication port 101*a* (102*a*) with reliability. As a result, the shape of the under blade seal 94 can be ensured with no variation, so that it is possible to seal the gap between the developing device frame 71 and the regulating blade 73 with reliability. Further, by providing the communication port 101*a* (102*a*) at the position as shown in FIG. 13, the elastomer resin material can closely contact the end seal member 95*a* (95*b*) with no gap, so that the sealing can be realized with reliability.

The ejection of the elastomer resin material may also be completed by detecting the flowing of the excessive portion 94*a* (94*b*) of the elastomer resin material into the resin material reservoir portion 101*b* (102*b*) with a sensor or the like.

The communication ports 101*a* and 102*a* are provided in the neighborhood of the end seal members 95*a* and 95*b* located on flow-path end sides of the elastomer resin material. Therefore, the elastomer resin material flows into the communication ports 101*a* and 102*a* after closely contacting the elastomer resin materials 95*a* and 95*b* with reliability and then flows into the resin material reservoir portions 101*b* and 102*b*. Further, each of the communication ports 101*a* and 102*a* has a cross-sectional area smaller than an area of the bottom surface of the recess 71*d*1. Therefore, the elastomer resin material contacts the end seal members 95*a* and 95*b* previously and thereafter can flow into the communication ports 101*a* and 102*a* with a narrower flow path and then can flow into the resin material reservoir portions 101*b* and 102*b*.

In this embodiments, the buffer portions 101 and 102 are provided on the back surface side of the seal forming portion 71*d*, i.e., on a side opposite from the developing roller 22 with respect to the seal forming portion 71*d*. For that reason, there is no need to worry about the contact of the excessive elastomer resin material, flowing into the resin material reservoir portions 101*b* and 102*b*, with the developing roller 22 or the like, so that the excessive elastomer resin material is not required to be subjected to post-process.

As described above, after the injection of the elastomer resin material is completed, as shown in FIG. 15, when the seal mold 83 is removed, the under blade seal 94 is provided to the developing device frame 71 of the developing container 70B through the injection molding. When the seal mold 83 is removed, the adhesiveness exerted between the under blade seal 94 and surfaces 71*h* and 71*j* constituting the recess 71*d*1 of the seal forming portion 71*d* generates a shearing reaction force with respect to the removal direction of the seal mold 83. For that reason, the under blade seal 94 is left on the developing device frame 71 side and is not taken by the seal mold 83, thus resulting in a state in which the under blade seal 94 is formed at the seal forming portion of the developing device frame 71 with reliability.

As described above, according to this embodiment, the developing device frame unit 71A to which the regulating member (regulating blade) 73*b* for regulating a layer thickness of the developer on the developer carrying member (the developing roller 22) is mounted can be suitably manufactured through the following steps. That is, the manufacturing method of the developing device frame unit 71A according to this embodiment includes:

(a) a first end seal member mounting step of mounting (assembling) the end seal member 95*a* to the developing device frame 71A on one longitudinal end side of the developing device frame 71A, (b) a second end seal member mounting step of mounting the end seal member 95*b* to the developing device frame 71A on the other longitudinal end side of the developing device frame 71A, and then (c) a seal member molding step of molding the seal member 94 connecting one end seal member 95*a* and the other end seal member 95*b* by injecting the elastomer resin material from the injection ports 76*a* and 76*b* into the seal forming portion 71*d* by using the mold 83, in order to prevent the toner leakage by sealing the gap between the regulating blade 73 and the developing device frame 71. In the seal member molding step (c), the amount of the elastomer resin material injected is larger than the volume of a space defined by the mold 83, the seal forming portion 71*d*, one end seal member 95*a*, and the other end seal member 95*b* so as to flow out of the space.

However, the seal member may also be molded by methods, other than the above-described molding method in this embodiment, such as coinjection molding and insert molding.

Embodiment 2

Figure 16:
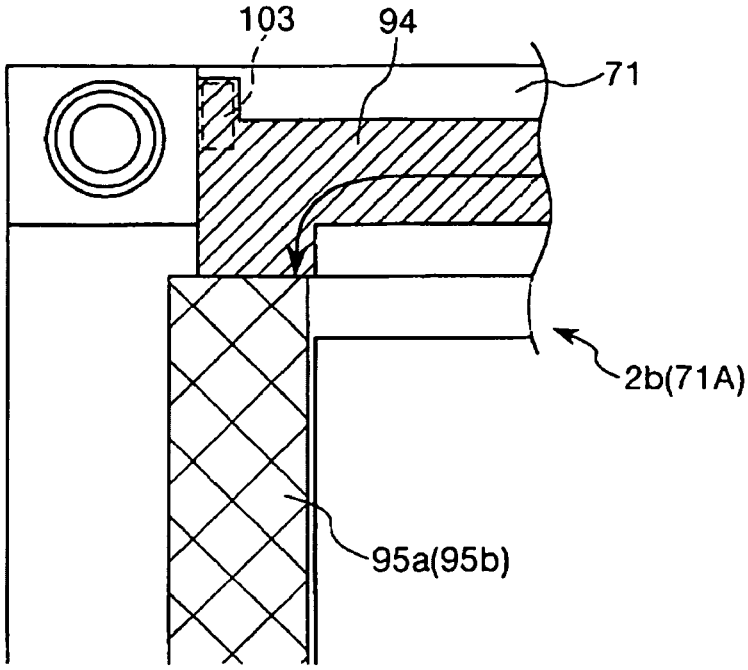
FIGS. 16(*a*) and 16(*b*) are schematic front views showing a position of the buffer portion in another embodiment.
Figure 16:
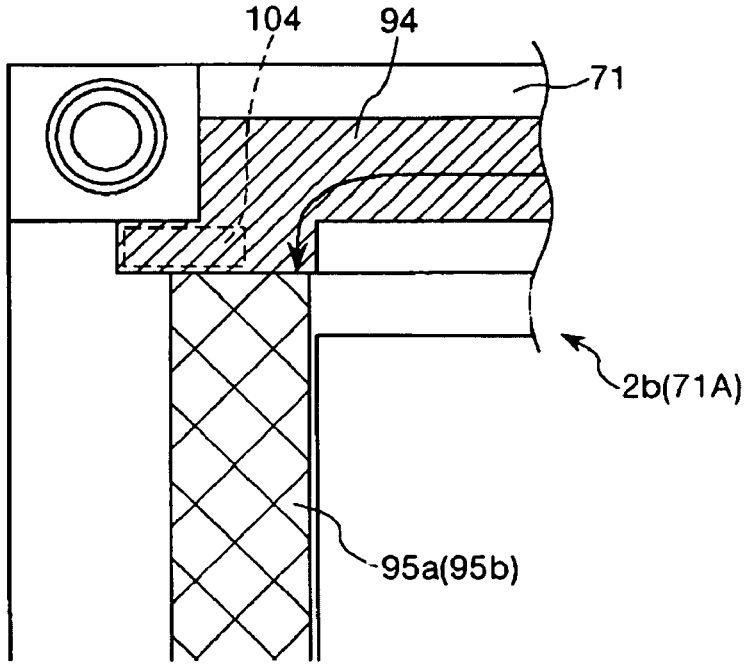
Figure 17:
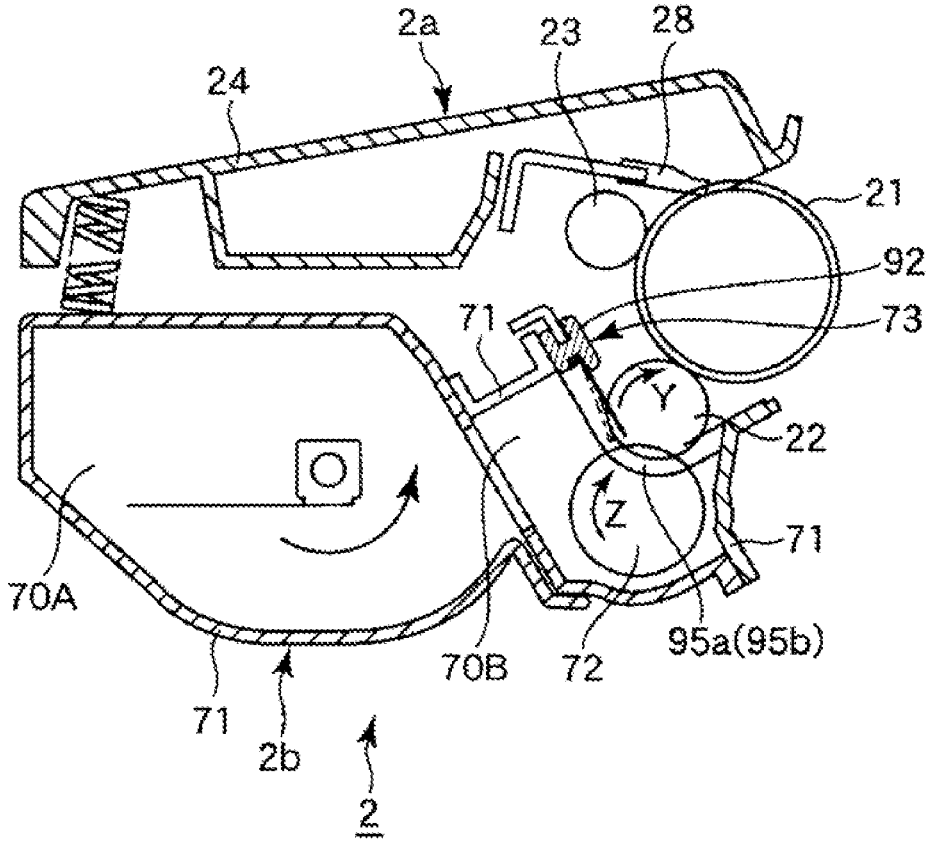
FIG. 17 is a schematic sectional view showing an embodiment of a conventional process cartridge.
Figure 18:
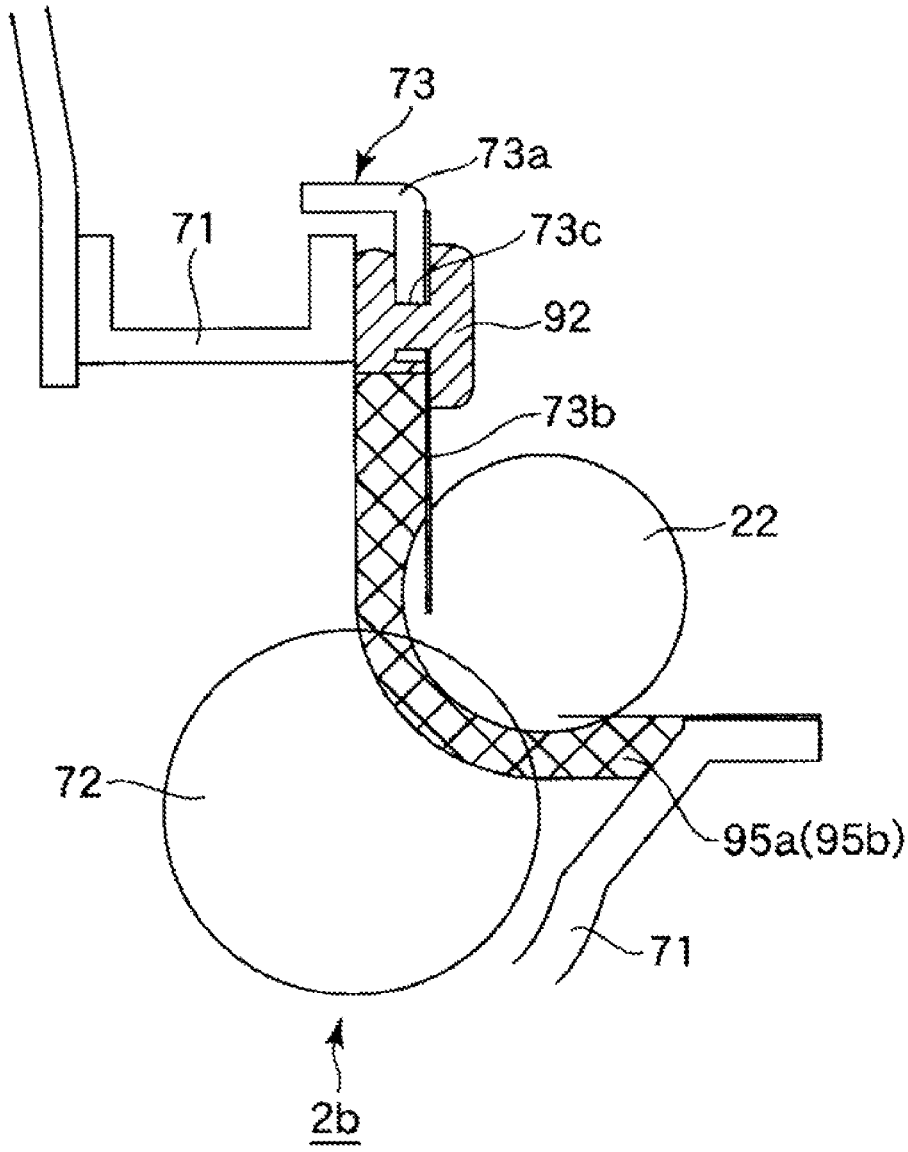
FIG. 18 is a partial schematic sectional view showing a conventional developing unit.
Figure 19:
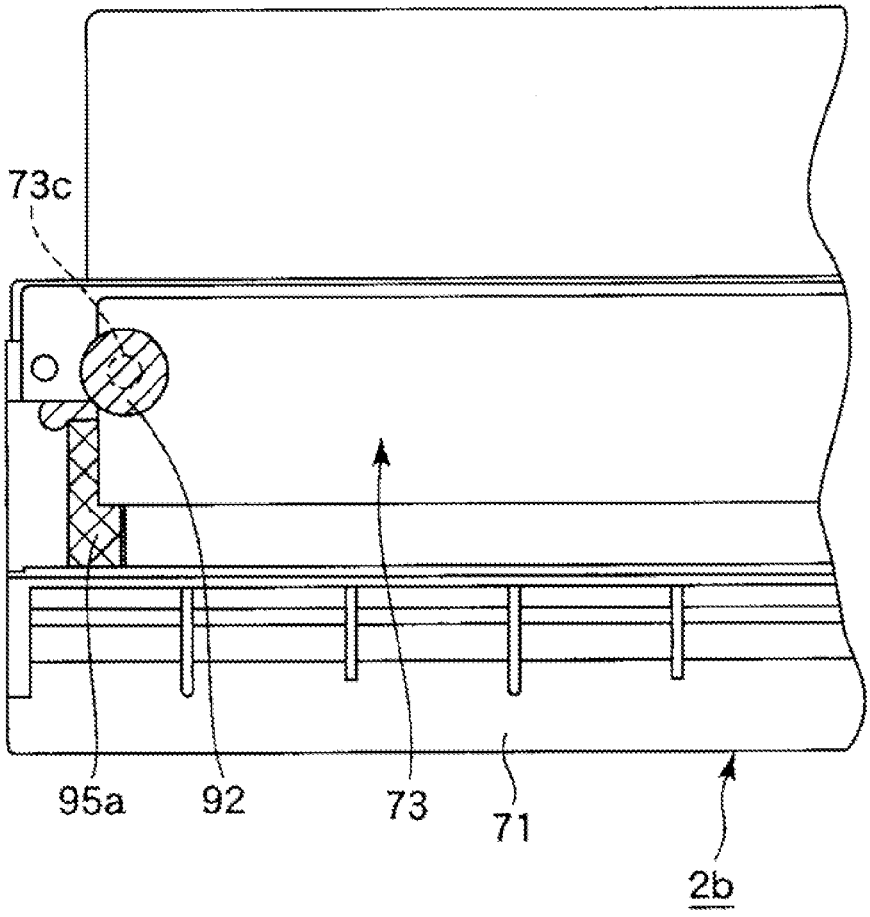
FIG. 19 is a partial schematic front view showing the conventional developing unit.
Figure 20:
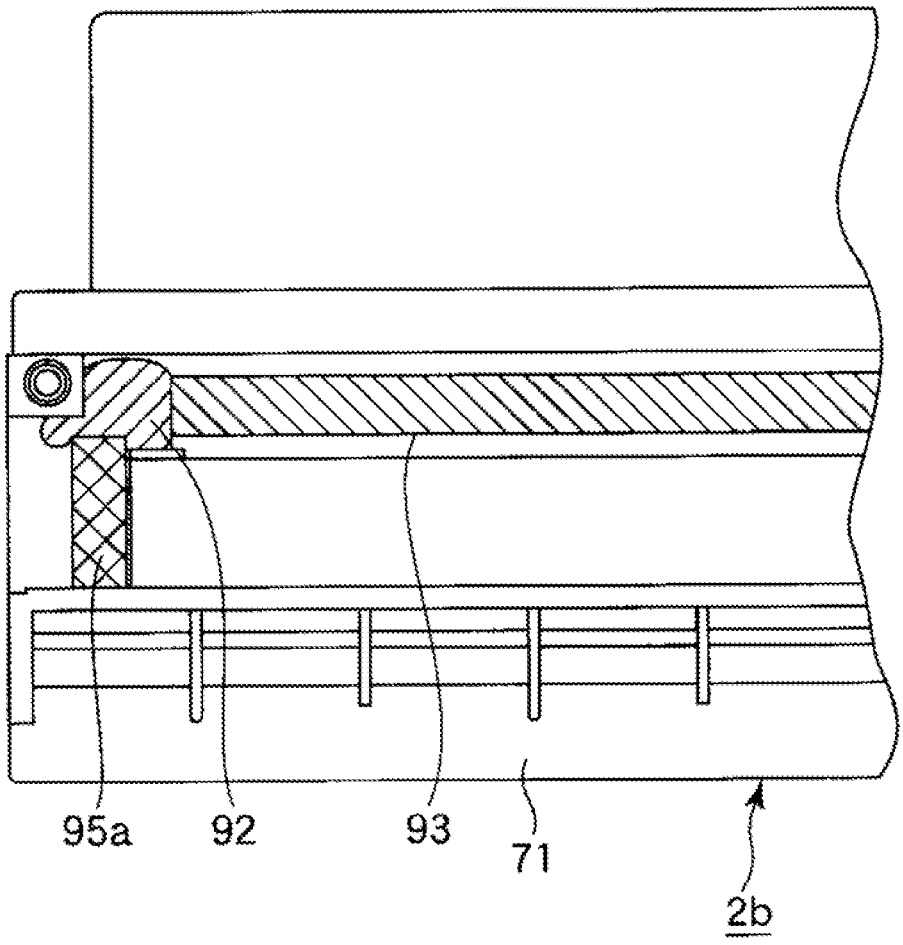
FIG. 20 is a schematic front view showing a state in which a developing blade unit is removed from a conventional developing container.

FIGS. 16(*a*) and 16(*b*) are schematic front views showing positions of the buffer portions in Embodiment 2 as another embodiment of the present invention. In Embodiment 1, the communication ports 101*a* and 102*a* are provided at the positions on the flow path of the elastomer resin material from the injection ports to the end seal members at the seal forming portion and are located in the neighborhood of the end seal members 95*a* and 95*b*.

In Embodiment 2, a buffer portion 103 enclosed by dotted lines as shown in FIG. 16(*a*) is provided. The buffer portion 103 also falls within the buffer portion described above in the present invention, which is disposed between the end seal members 95*a* and 95*b* and in the neighborhood of the end seal members 95*a* and 95*b*.

By this constitution, the elastomer resin material closely contacts the end seal members 95*a* and 95*b* with reliability and thereafter flows into the buffer portion 103. As a result, an effect similar to that in Embodiment 1 can be achieved.

Further, a buffer portion 104 enclosed by dotted lines as shown in FIG. 16(*b*) also falls within the buffer portion described above in the present invention and can flow into the buffer portion 104 after closely contacting the end seal members 95*a* and 95*b* with reliability, thus achieving the same effect.

Embodiment 3

Figure 21:
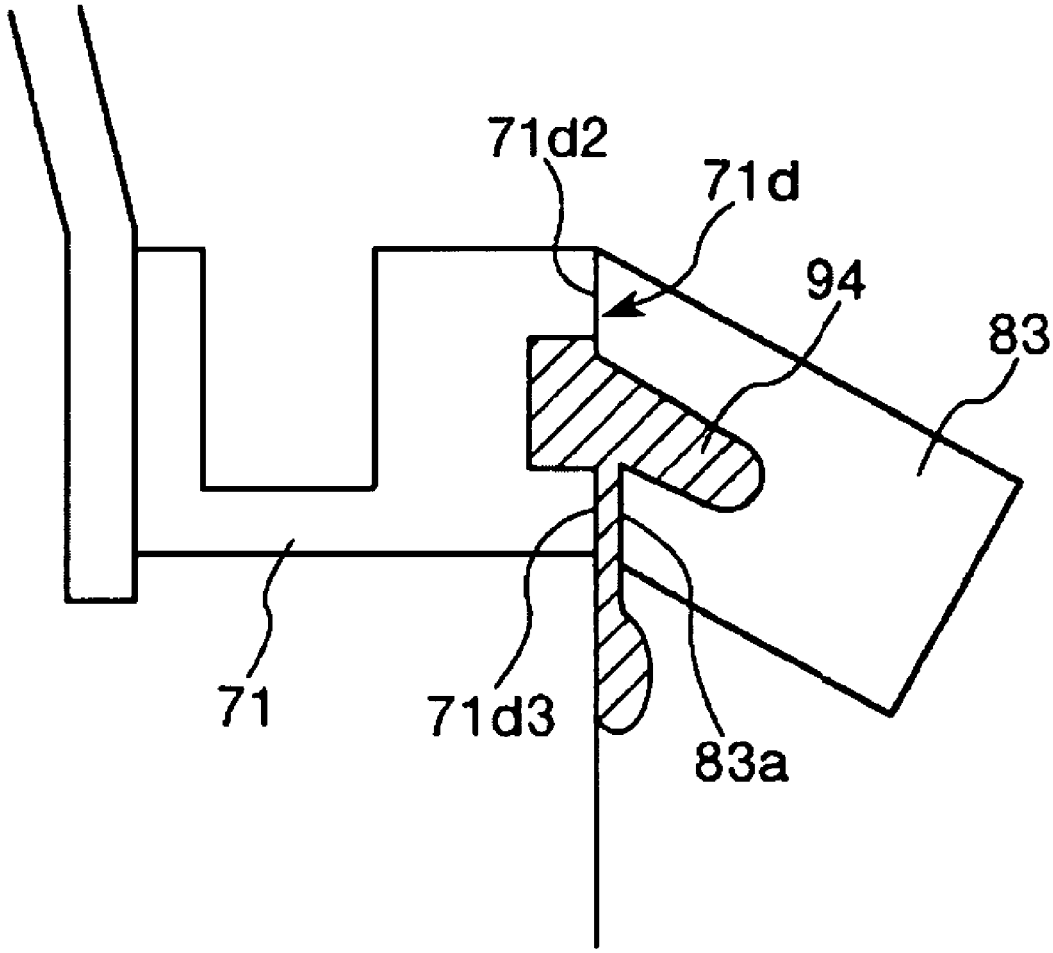
FIG. 21 is a schematic sectional view showing a buffer portion of a developing device frame unit 71A in an embodiment of the present invention.
Figure 22:
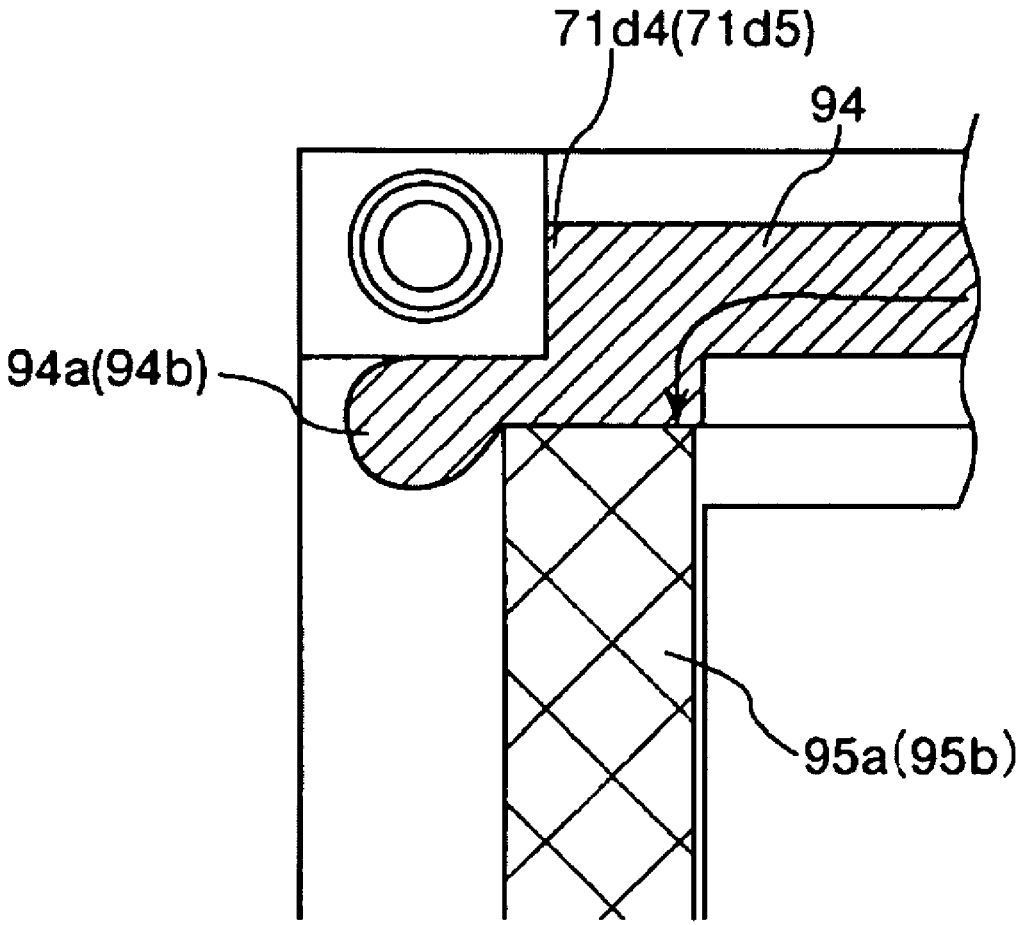
FIG. 22 is a schematic front view showing a longitudinal end portion in a state in which an under blade seal 94 in the embodiment of the present invention is formed.

FIG. 21 is a schematic sectional view showing a buffer portion of the developing device frame unit 71A in Embodiment 3, FIG. 22 is a schematic front view showing a longitudinal end portion of the developing device frame unit 71A in a state in which an under blade seal 94 in Embodiment 3 is molded.

In Embodiment 1, the excessive portion 94*a* (94*b*) of the elastomer resin material is caused to flow into the resin material reservoir portion 101*b* (102*b*) of the buffer portion 101 (102).

In this embodiment, the resin material reservoir portion 101*b* (102*b*) is not provided for the excessive portion (protrusion) 94*a* (94*b*) of the elastomer resin material but a flow path 83*a* is provided to the mold 83 as shown in FIG. 21, so that the excessive portion of the elastomer resin material is caused to flow through the flow path 83*a*. The flow path 83*a* is provided at a position, as shown in FIG. 22, in which the excessive portion 94*a* (94*b*) of the elastomer resin material is caused to flow outwardly, with respect to the longitudinal direction of the developing device frame 71, immediately before the end seal member 95*a* (95*b*). At this position, the excessive portion 94*a* (94*b*) does not adversely affect the developing roller 22. The flow path 83*a* has a cross-sectional area smaller than an area of a side surface of the recess 71*d*1. Therefore, the elastomer resin material can flow into the flow path 83*a* after contacting the end seal member 95*a* (95*b*). Further, the flow path 83*a* is provided between the bent portion (corner portion) 71*d*4 (71*d*5) and the end seal member 95*a* (95*b*). Therefore, the elastomer resin material can sufficiently contact the end seal member 95*a* (95*b*), so that it is possible to ensure close contact between the end seal member 95*a* (95*b*) and the under blade seal 94. In this embodiment, other constitutions are similar to those in Embodiment 1, thus being omitted from illustration.

According to the present invention, in the developing device frame unit to which the regulating member for regulating the layer thickness of the developer on the developer carrying member is mounted, it is possible to achieve the following functional effects.

(a) Even when there is a variation in mounting position of the end seal members, the blade seal member disposed between one end seal member and the other end seal member closely contacts one end seal member and the other end seal member, thus stabilizing a sealing property at a boundary portion between the blade seal member and the end seal members.

(b) The blade seal member is molded so as to fill the gap between one end seal member and the other end seal member, so that the seal constitution is simplified and the number of assembling steps is decreased, thus resulting in a reduced manufacturing cost.

(c) The blade seal member is directly molded on the developing device frame, thus improving the ease of assembly.

(d) By providing the excessive portion of the elastomer resin material, the blade seal member can be molded with no variation, so that it is possible to perform the sealing of the gap between the developing device frame and the regulating member with reliability.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 093929/2008 filed Mar. 31, 2008 and 001164/2009 filed Jan. 6, 2009, which is hereby incorporated by reference.

What is claimed is:

1. A developing device frame unit comprising:

a developing device frame having a seal forming portion;

a one end sealing member which is provided at one longitudinal end of said developing device frame and which is contactable to a surface of a developer carrying member to prevent the developer from leaking from said developing device frame unit in an axial direction of the developer carrying member when the developer carrying member is mounted on said developing device frame unit;

an other end sealing member which is provided at the other longitudinal end of said developing device frame and which is contactable to the surface of the developer carrying member to prevent the developer from leaking from said developing device frame unit in an axial direction of the developer carrying member when the developer carrying member is mounted on said developing device frame unit;

a blade sealing member configured to provide a seal between a regulating member mountable on said developing device frame unit and said developing device frame to prevent the developer from leaking out of said developing device frame unit when the regulating member is mounted on said developing device frame unit, wherein said blade sealing member comprises an elastomer resin material which is injection-molded with a metal mold and which is provided in said seal forming portion where said one end sealing member and said other end sealing member are provided, said blade sealing member connecting said one end sealing member and said other end sealing member with each other; and a protrusion comprising a squeezed-out portion of the elastomer resin material, wherein the squeezed-out portion is provided by injecting, into a space defined by the metal mold, said seal forming portion, said one end sealing member, and said other end sealing member, a volume of the elastomer resin material that is larger than the volume of the space.

2. A developing device frame unit according to claim 1, wherein said developing device frame further comprises a buffer portion accommodating said protrusion.

3. A developing device frame unit according to claim 1, wherein said protrusion is formed between an injection port through which the elastomer resin material is injected into said developing device frame unit and said one end sealing member and/or between the injection port and said other end sealing member, when said blade sealing member is injection-molded.

4. A developing device frame unit according to claim 3, wherein said developing device frame is provided with said injection port.

5. A developing device frame unit according to claim 1, wherein said seal forming portion extends along the regulating member when the regulating member is mounted to said developing device frame unit and then bends toward said one end sealing member to provide a first bent portion, and said protrusion is formed between the first bent portion and said one end sealing member.

6. A developing device frame unit according to claim 5, wherein said seal forming portion also extends along the regulating member when the regulating member is mounted to said developing device frame unit and then bends toward said other end sealing member to provide a second bent portion, and said protrusion is formed between said second bent portion and said other end sealing member.

7. A developing apparatus for developing an electrostatic latent image formed on an image bearing member, said apparatus comprising:

(i) a developer carrying member configured to develop the electrostatic latent image with a developer.

(ii) a developer accommodating portion configured to accommodate the developer;

(iii) a regulating member configured to regulate the layer thickness of the developer on said developer carrying member; and (iv) a developing device frame unit, including a developing device frame including a seal forming portion, a one end sealing member which is provided at one longitudinal end of said developing device frame and which is contactable to a surface of said developer carrying member to prevent the developer from leaking from said developing device frame unit in an axial direction of said developer carrying member when said developer carrying member is mounted to said developing device frame unit, an other end sealing member which is provided at the other longitudinal end of said developing device frame and which is contactable to the surface of said developer carrying member to prevent the developer from leaking from said developing device frame unit in an axial direction of said developer carrying member when said developer carrying member is mounted to said developing device frame unit, a blade sealing member configured to provide a seal between said regulating member and said developing device frame to prevent the developer from leaking out of said developing device frame unit when said regulating member is mounted to said developing device frame unit, wherein said blade sealing member comprises an elastomer resin material which is injection-molded with a metal mold and which is provided in said seal forming portion where said one end sealing member and said other end sealing member are provided, said blade sealing member connecting said one end sealing member and said other end sealing member with each other, and a protrusion provided by a squeezed-out portion of the elastomer resin material, wherein the squeezed-out portion is provided by injecting, into a space defined by the metal mold, said seal forming portion, said one end sealing member and the other end sealing member, a volume of the elastomer resin material that is larger than the volume of the space.

8. An apparatus according to claim 7, wherein said developing device frame is provided with a buffer portion accommodating said protrusion.

9. An apparatus according to claim 7, wherein said protrusion is formed between an injection port through which the elastomer resin material is injected and said one end sealing member and/or between the injection port and said other end sealing member, when said blade sealing member is injection-molded.

10. An apparatus according to claim 9, wherein said developing device frame is provided with said injection port.

11. An apparatus according to claim 7, wherein said seal forming portion extends along said regulating member and is then bent toward said one end sealing member to provide a first bent portion, and said protrusion is formed between the first bent portion and said one end sealing member.

12. An apparatus according to claim 11, wherein said seal forming portion also extends along said regulating member and is then bent toward said other end sealing member to provide a second bent portion, and said protrusion is formed between the second bent portion and said other end sealing member.

13. A process cartridge detachably mountable to a main assembly of an image forming apparatus, said process cartridge comprising;

(i) an image bearing member;

(ii) a developer carrying member configured to develop an electrostatic latent image formed on said image bearing member with a developer;

(iii) a developer accommodating portion configured to accommodate the developer;

(iv) a regulating member configured to regulate the layer thickness of the developer on said developer carrying member; and (v) a developing device frame unit, including a developing device frame including a seal forming portion, a one end sealing member which is provided at one longitudinal end of said developing device frame and which is contactable to a surface of said developer carrying member to prevent the developer from leaking from said developing device frame unit in an axial direction of said developer carrying member when said developer carrying member is mounted to said developing device frame unit, an other end sealing member which is provided at the other longitudinal end of said developing device frame and which is contactable to the surface of said developer carrying member to prevent the developer from leaking from said developing device frame unit in an axial direction of said developer carrying member when said developer carrying member is mounted to said developing device frame unit, a blade sealing member configured to provide a seal between said regulating member and said developing device frame to prevent the developer from leaking out of said developing device frame unit when said regulating member is mounted to said developing device frame unit, wherein said blade sealing member comprises an elastomer resin material which is injection-molded with a metal mold and which is provided in said seal forming portion where said one end sealing member and said other end sealing member are provided, said blade sealing member connecting said one end sealing member and said other end sealing member with each other, and a protrusion provided by a squeezed-out portion of the elastomer resin material, wherein the squeezed-out portion is provided by injecting, into a space defined by the metal mold, said seal forming portion, said one end sealing member and said other end sealing member, a volume of the elastomer resin material that is larger than the volume of the space.

14. A process cartridge according to claim 13, wherein said developing device frame is provided with a buffer portion accommodating said protrusion.

15. A process cartridge according to claim 13, wherein said protrusion is formed between an injection port through which the elastomer resin material is injected and said one end sealing member and/or between the injection port and said other end sealing member, when said blade sealing member is injection-molded.

16. A process cartridge according to claim 15, wherein said developing device frame is provided with said injection port.

17. A process cartridge according to claim 13, wherein said seal forming portion extends along said regulating member and is then bent toward said one end sealing member to provide a first bent portion, and said protrusion is formed between the first bent portion and said one end sealing member.

18. A process cartridge according to claim 17, wherein said seal forming portion also extends along said regulating member and is then bent toward said other end sealing member to provide a second bent portion, and said protrusion is formed between the second bent portion and said other end sealing member.

19. A manufacturing method for a developing device frame unit comprising:

a step of mounting a first end sealing member which is provided at one longitudinal end of a developing device frame of a developing device frame unit and which is contactable to a surface of a developer carrying member mountable on the developing device frame unit to prevent the developer from leaking from the developing device frame unit in an axial direction of the developer carrying member when the developer carrying member is mounted on the developing device frame unit;

a step of mounting a second end sealing member which is provided at the other longitudinal end of the developing device frame and which is contactable to the surface of the developer carrying member to prevent the developer from leaking from the developing device frame unit in an axial direction of the developer carrying member when the developer carrying member is mounted on the developing device frame unit; and a sealing member molding step of molding a blade sealing member configured to provide a seal between the regulating member and the developing device frame to prevent the developer from leaking from the developing device frame unit when the regulating member is mounted on the developing device frame unit, wherein the blade sealing member comprises an elastomer resin material which is injection-molded with a metal mold and which is provided in a seal forming portion of the developing device frame where the first end sealing member and the second end sealing member are provided, the blade sealing member connecting the first end sealing member and the second end sealing member with each other, said sealing member molding step including the step of providing a protrusion provided by a squeezed-out portion of the elastomer resin material, wherein the squeezed-out portion is provided by injecting, into a space defined by the metal mold, the seal forming portion, the first end sealing member and the second end sealing member, a volume of the elastomer resin material that is larger than the volume of the space.

20. A method according to claim 19, wherein in said sealing member molding step, the injection of the elastomer resin material is finished after the elastomer resin material is squeezed out into a buffer portion of the developing device frame unit.

* * * * *